US008198560B2

(12) United States Patent
Kimata et al.

(10) Patent No.: US 8,198,560 B2
(45) Date of Patent: Jun. 12, 2012

(54) SWITCH DEVICES FOR POWER TOOLS

(75) Inventors: Hirokazu Kimata, Anjo (JP); Fumitoshi Numata, Anjo (JP); Junichi Nishikimi, Anjo (JP); Akira Tomonaga, Anjo (JP); Tatsuya Yoshizaki, Anjo (JP)

(73) Assignee: Makita Corporation, Anjo-Shi (JP)

( * ) Notice: Subject to any disclaimer, the term of this patent is extended or adjusted under 35 U.S.C. 154(b) by 273 days.

(21) Appl. No.: 12/654,686

(22) Filed: Dec. 29, 2009

(65) Prior Publication Data

US 2010/0175972 A1 Jul. 15, 2010

(30) Foreign Application Priority Data

Jan. 9, 2009 (JP) ..... 2009-003636
Jan. 26, 2009 (JP) ..... 2009-014081

(51) Int. Cl.
*H01H 1/52* (2006.01)

(52) U.S. Cl. ..... 200/318.1

(58) Field of Classification Search ..... 200/318.1, 200/50.32–50.4, 332.2, 320, 43.17, 43.16, 200/321–322, 556, 16 A
See application file for complete search history.

(56) References Cited

U.S. PATENT DOCUMENTS 3,873,796 A 3/1975 Worobec, Jr.
5,577,600 A * 11/1996 Schoene et al. ..... 200/43.17
5,911,318 A * 6/1999 Miyazaki ..... 200/556
6,274,828 B1 * 8/2001 Chu ..... 200/43.17
6,538,218 B2 * 3/2003 Bascom et al. ..... 200/43.17
2008/0149467 A1 6/2008 Somalingayya et al.

FOREIGN PATENT DOCUMENTS

| | | | |
|---|---|---|---|
| CN | 1187019 | A | 7/1998 |
| DE | 36 38 952 | A1 | 5/1988 |
| DE | 10 2008 014 430 | A1 | 9/2008 |
| EP | 0 848 399 | A1 | 6/1998 |
| GB | 2 240 877 | A | 8/1991 |
| JP | A-9-27262 | | 1/1997 |
| JP | A-09-290377 | | 11/1997 |
| WO | WO 2007/121534 | A1 | 11/2007 |
| WO | WO 2008/036226 | A2 | 3/2008 |

OTHER PUBLICATIONS

May 6, 2011 Office Action issued in Chinese Patent Application No. 201010000296.9 (with translation).
European Search Report dated Jul. 21, 2010 in European Patent Application No. 10 00 0123.9.

* cited by examiner

*Primary Examiner* — Edwin A. Leon
(74) *Attorney, Agent, or Firm* — Oliff & Berridge, PLC

(57) ABSTRACT

One aspect according to the present invention includes a switch device for a power tool. The switch device includes a switch lever operable to move between an ON position for activating the power tool and an OFF position for stopping activation of the power tool. An on-lock mechanism can lock the switch lever in the ON position. An off-lock mechanism can lock the switch lever in the OFF position. The operation for making the on-lock mechanism effective and the operation for releasing the off-lock mechanism are performed by operating an operation member in different directions from each other or by operating two separate operation members.

21 Claims, 26 Drawing Sheets

SWITCH DEVICES FOR POWER TOOLS

This application claims priority to Japanese patent application serial numbers 2009-003636 and 2009-014081, the contents of which are incorporated herein by reference.

BACKGROUND OF THE INVENTION

1. Field of the Invention

The present invention relates to switch devices for operating electric power tools, such as hand-held disk grinders for stone cutting use and others.

2. Description of the Related Art

A known hand-held disk grinder includes a body part, a gear head, and a handle. The body part is provided therein an electric motor serving as a driving source. The gear head is mounted to the front portion of the body part, and the handle is mounted to the rear portion of the body part.

The gear head includes a gear case, in which a gear train is provided for reducing the rotation of the electric motor. The rotation after reduction by the gear train is transmitted to a spindle, to which a disk-shaped grindstone is mounted.

The handle can be held by a user of the electric power tool with his or her hand, and the lower portion thereof is provided with a switch lever that can be pulled or slid by the user between an ON position and an OFF position using his or her finger tip. When the user moves the switch lever to the ON position by pulling it using his or her finger tip while holding the handle (i.e., grasping the switch lever together with the handle), a power supply circuit is turned ON so that the electric motor in the body part is started. In response to starting of the electric motor, the rotation thereof is transmitted to the spindle via a driving head so that the grindstone is rotated. When the switch lever is released from being pulled, the switch lever is responsively returned to the OFF position by a spring biasing force or others, and the power supply circuit is thus cut off, whereby the electric motor is stopped.

As such switch devices having switch levers, those provided with on-lock and off-lock mechanisms have been proposed. With the on-lock mechanism, the switch lever is locked in the ON position, and with the off-lock mechanism, the switch lever is locked in the OFF position. With the on-lock mechanism provided as such, the switch lever is held at the ON position without need of being held in the state after being pulled by the user, and the electric motor is locked in the state of activation. This accordingly increases the workability of the electric power tool, i.e., the ease of use of the switch device, so that the long-hour work can be performed with ease, for example. On the other hand, with the off-lock mechanism, after being once locked in the OFF position, the switch lever is not allowed to move to the ON position even if the user pulls the switch lever. This accordingly prevents the electric motor from being accidentally started.

For performing such a switching operation between the on-lock and off-lock mechanisms, DE3638952C2 proposes a lock operation member that utilizes the movement of the switch lever itself, and Japanese Laid-Open Patent Publication No. 9-290377 (Japanese Patent No. 2977076) proposed to use a lever, a push button, or others that are provided separately from the switch lever.

According to the known switch devices provided with both the on-lock and off-lock mechanisms, it is possible to improve the workability of the electric power tool and ease of use of the switch devices, and at the same time it is possible to prevent the electric power tool from being accidentally activated or to prevent the switch devices from being accidentally turned ON.

However, the known switch devices provided with both the on-lock and off-lock mechanisms are operated substantially in the same direction to release the off-lock mechanism and to activate the on-lock mechanism. Therefore, there has been a possibility that the user erroneously operates the switch devices to release the off-lock mechanism and to activate the on-lock mechanism as a series of operation.

Thus, when the user wants to use the electric power tool by releasing the switch lever from being in the off-lock state, i.e., in the state where the switch lever is not allowed to move to the ON position for operation due to the off-lock mechanism, he or she may accidentally activate the on-lock mechanism irrespective of his or her intention of operating the switch lever to only release it from being in the off-lock state, thereby locking the switch lever in the ON position. If this happens, even if the user stops pulling the switch lever to stop the electric power tool, the electric power tool remains in the state of activation. Hence, the known switch devices have the problem of the difficulty in specifically responding to the user's intension in terms of switching between the operation of releasing the switch lever from being in the off-lock state and the operation of putting the switch lever in the on-lock state.

Therefore, there is a need in the art for a switch device that includes both on-lock and off-lock mechanisms and can reliably respond to a user's intension in terms of switching between the operation of releasing the switch lever from being in the off-lock state and the operation of bringing the switch lever into the on-lock state.

SUMMARY OF THE INVENTION

One aspect according to the present invention includes a switch device for a power tool. The switch device includes a switch lever operable to move between an ON position for activating the power tool and an OFF position for stopping activation of the power tool. An on-lock mechanism can lock the switch lever in the ON position. An off-lock mechanism can lock the switch lever in the OFF position. The operation for making the on-lock mechanism effective and the operation for releasing the off-lock mechanism are performed by operating an operation member in different directions from each other or by operating two separate operation members.

DETAILED DESCRIPTION OF THE INVENTION

Figure 1:
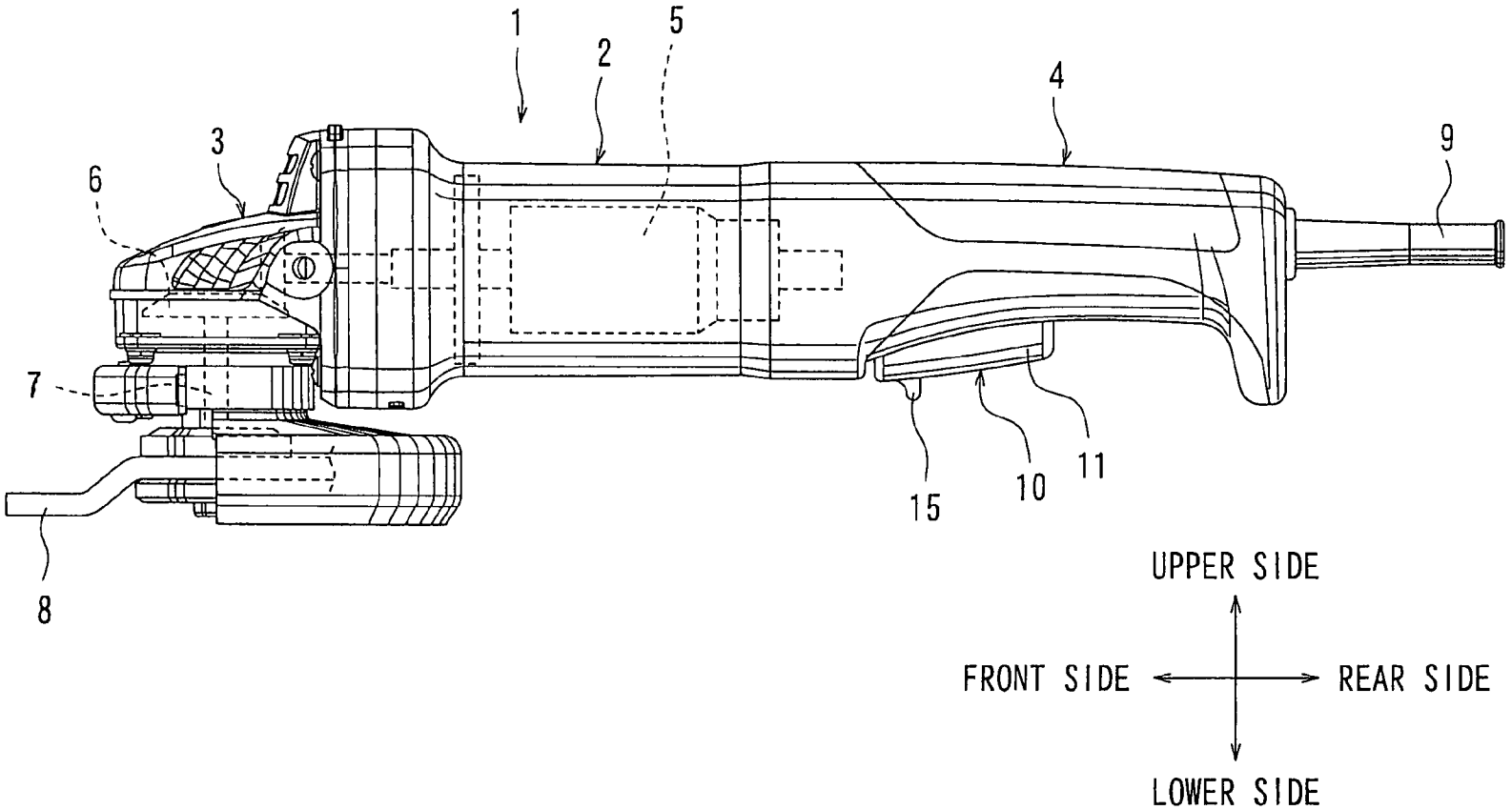
FIG. 1 is a side view of an electric power tool (disk grinder) in its entirety including a switch device according to a first embodiment of the invention.

Each of the additional features and teachings disclosed above and below may be utilized separately or in conjunction with other features and teachings to provide improved switch devices and power tools having such switch devices. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one embodiment, a switch device for a power tool includes a switch lever, an on-lock mechanism, an off-lock mechanism and a single lock operation member. The switch lever is operable to move between an ON position for activating the power tool and an OFF position for stopping activation of the power tool. The on-lock mechanism can lock the switch lever in the ON position. The off-lock mechanism can lock the switch lever in the OFF position. The single lock operation member is operable in a first direction for making the on-lock mechanism effective and is operable in a second direction for releasing the off-lock mechanism. The first direction and the second direction are different from each other.

With this arrangement, because the first direction and the second direction are different from each other, the use of the power tool can clearly distinguish between the operation for making the on-lock mechanism effective and the operation for releasing the off-lock mechanism. Therefore, it may not occur that the releasing the off-lock state (i.e., the state in which the off-lock mechanism is effective) is unintentionally changed to the on-lock state (i.e., the state in which the on-lock mechanism is effective). As a result, the user's intended operation can be reliably reflected.

The first direction and the second directions may be opposite to each other. With this arrangement, the two different operations may not be unintentionally made in series with each other.

The lock operation member may be a separate member from the switch lever. With this arrangement, it is possible to further reliably reflect the user's intended operation.

In another embodiment, there are provided a first operation member operable in a first direction for making the on-lock mechanism effective and a second operation member operable in a second direction for releasing the off-lock mechanism. The first operation member and the second operation members are separate members from each other.

Also with this arrangement, the use of the power tool can clearly distinguish between the first operation for making the on-lock mechanism effective and the second operation for releasing the off-lock mechanism. Therefore, it may not occur that the releasing the off-lock state (i.e., the state in which the off-lock mechanism is effective) is unintentionally changed to the on-lock state (i.e., the state in which the on-lock mechanism is effective). As a result, the user's intended operation can be reliably reflected.

In the case of the above configuration, the second direction may intersect with a direction for operating the switch lever between the ON position and the OFF position. This arrangement allows the first and second operations to be made as a series of operations, for example, by forwardly sliding the switch lever for releasing the off-lock state and thereafter moving the switch lever to the ON position in a direction intersecting with the sliding direction. Therefore, the off-lock releasing operation and the switch-on operation can be quickly performed as a series of operations. Hence, the operability of the switch device can be improved.

The first operation member may be a separate member from the switch lever. This arrangement enables to perform the off-lock releasing operation as an operation clearly distinguished from the operation of the switch lever. Therefore, the operator's intention can be further reliably reflected.

It may be also possible that the first and second operation members are separate members from the switch lever.

Embodiments of the present invention will now be described with reference to FIGS. 1 to 31.

First Embodiment

FIG. 1 shows an electric power tool 1 provided with a switch device 10 according to a first embodiment of the present invention. The electric power tool 1 is a hand-held disk grinder, and is provided with a tool body 2, a gear head 3, and a handle 4. The tool body 2 is coupled with The gear head 3 is coupled to the front portion of the tool body 2, and the handle 4 is mounted to the rear portion of the tool body 2.

The tool body 2 is provided therein an electric motor 5. The rotation of the electric motor 5 is transmitted to a spindle 7 after being reduced by a gear train 6 that is provided in the gear head 3. At the tip end of the spindle 7, a disk-shaped grindstone 8 is attached.

The handle 4 has a handle case 4*a* with the size and length enabling a user to easily hold by his or her hand, and extends rearwardly from the rear portion of the tool body 2. A power cord 9 for the supply of electric power extends into the rear end portion of the handle 4. With the power supplied from the power cord 9, the electric motor 5 of the tool body 2 is activated to rotate.

Figure 2:
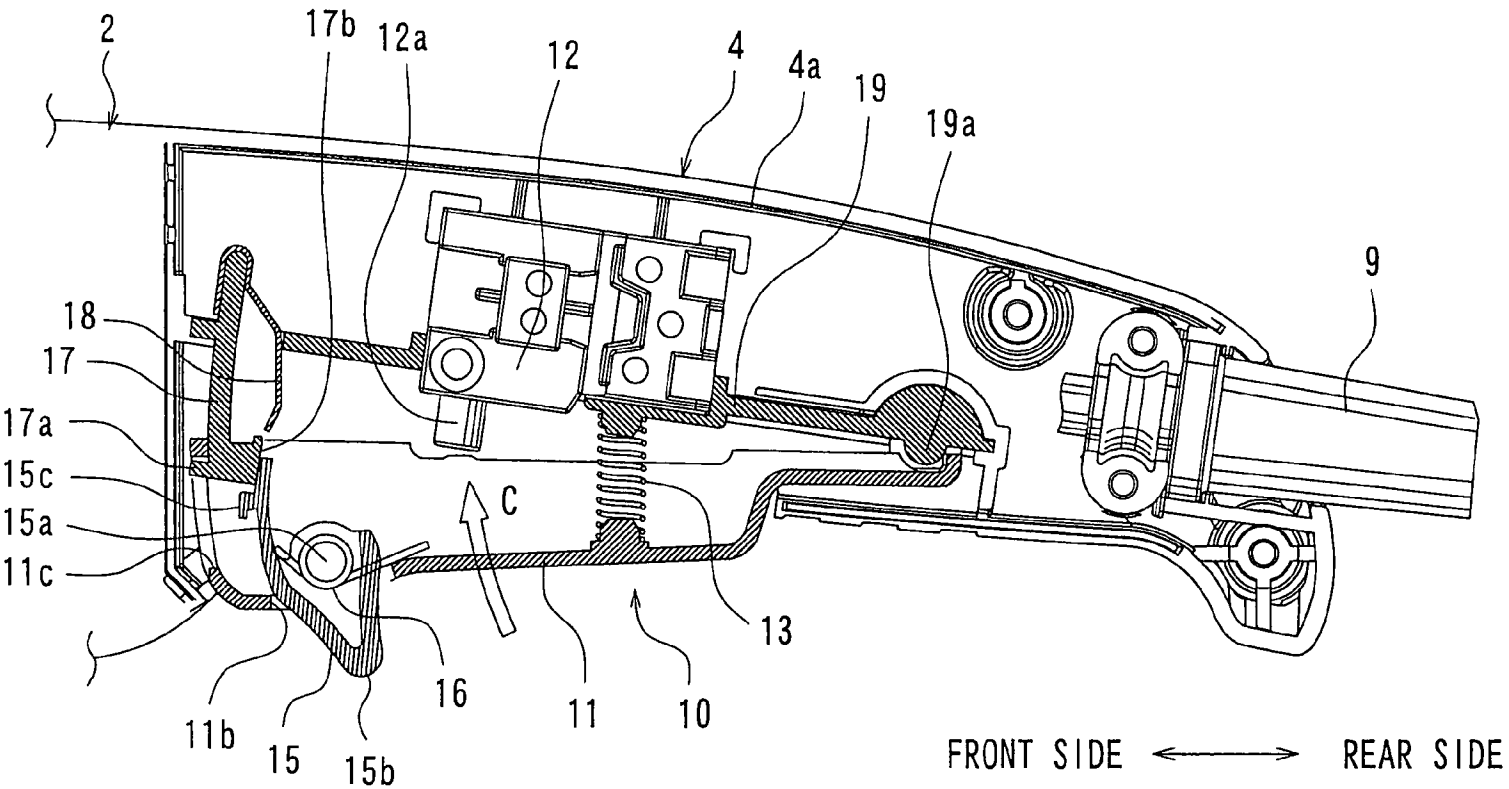
FIG. 2 is a vertical sectional view of a handle including the switch device of the first embodiment, and showing an off-lock state of the switch device.
Figure 3:
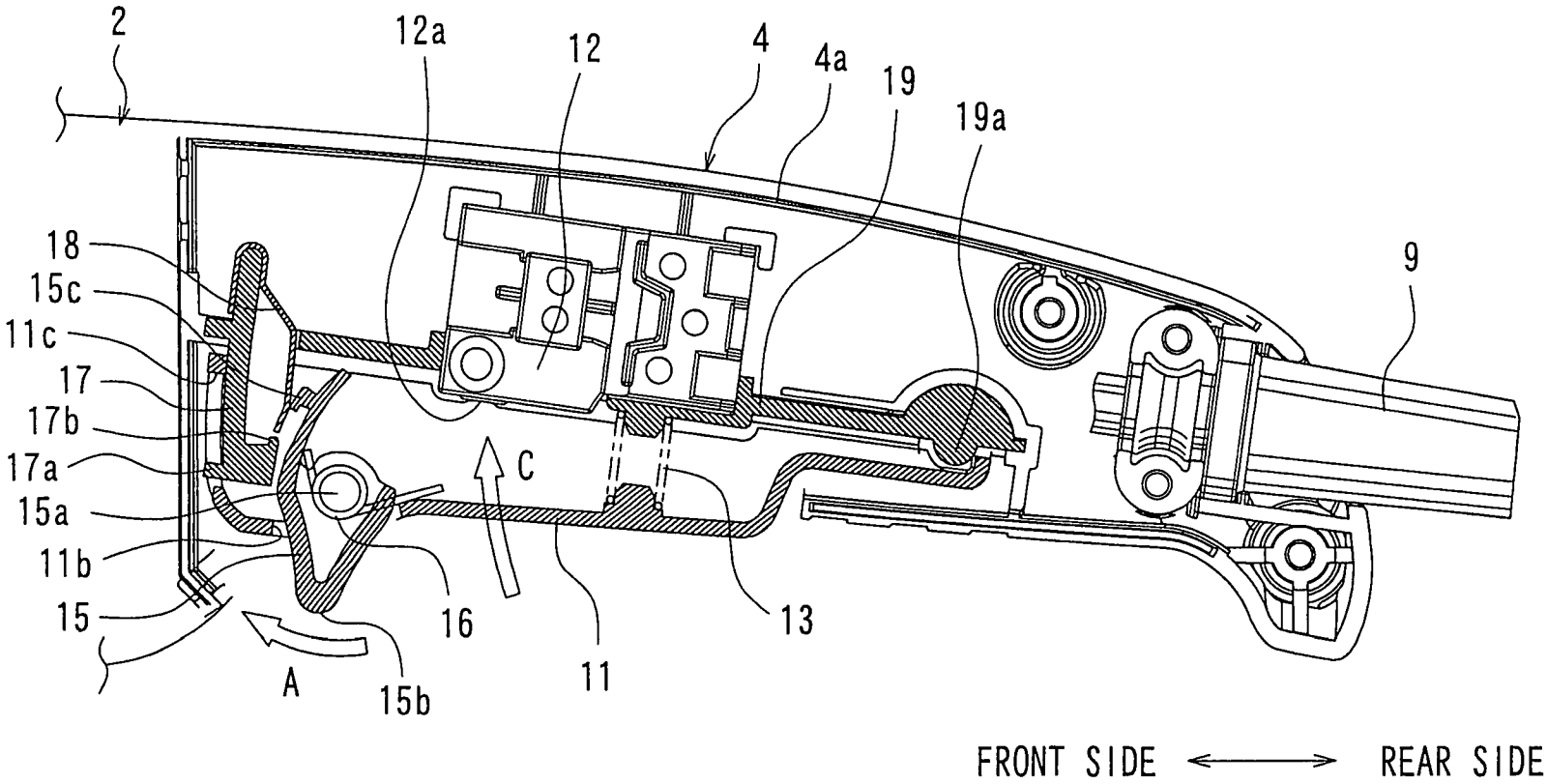
FIG. 3 is another vertical sectional view of the handle including the switch device of the first embodiment, and showing the state where the switch device is released from the off-lock state and a switch lever is operated to tilt toward an ON position.
Figure 4:
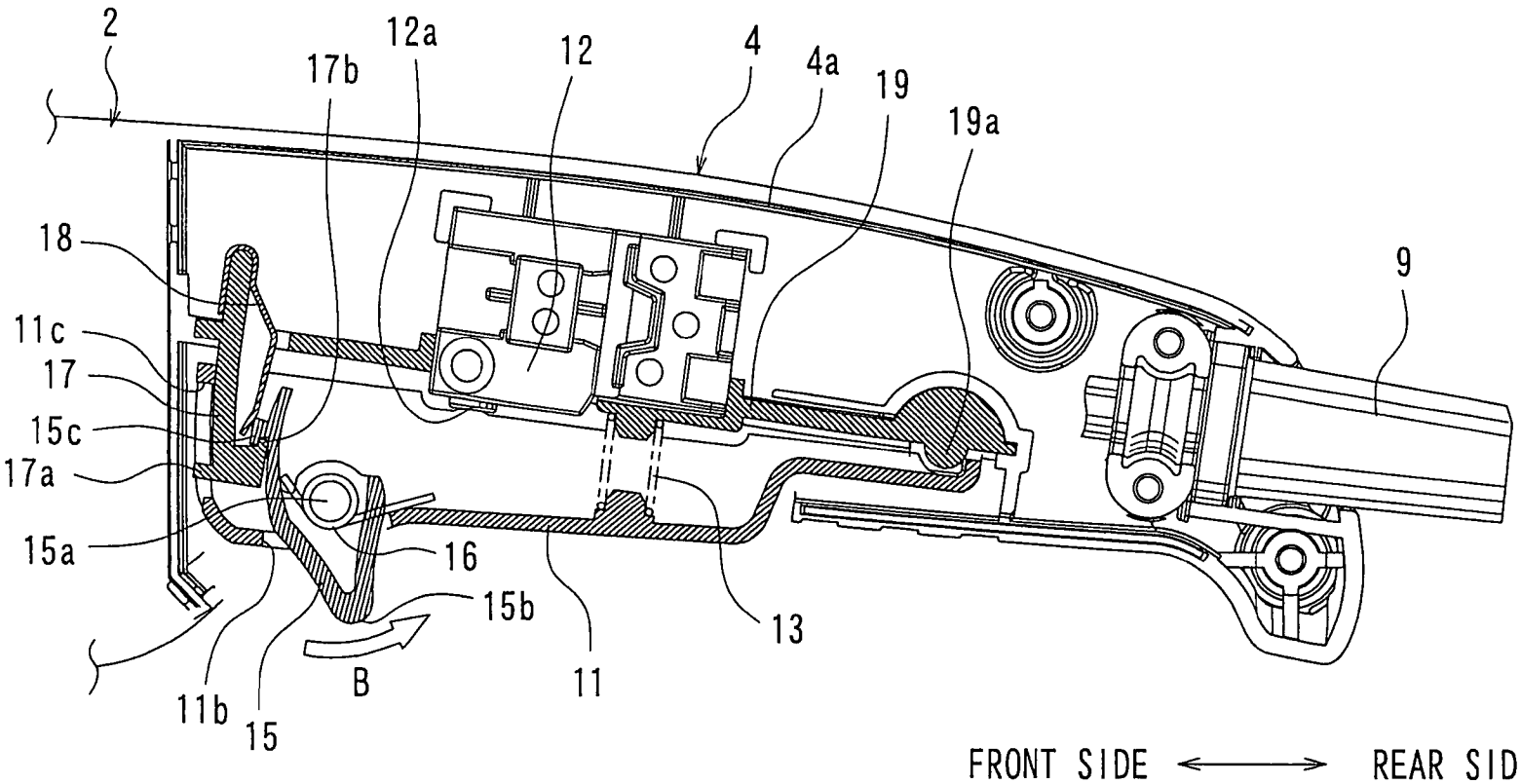
FIG. 4 is a further vertical sectional view of the handle including the switch device of the first embodiment, and showing an on-lock state of the switch device.

The handle 4 is provided, on its lower surface side, the switch device 10 of the first embodiment. FIGS. 2 to 4 show the detailed configuration of the switch device 10 of the first embodiment. This switch device 10 includes a switch base 19, a switch lever 11, and a switch body 12. The switch base 19 is fixed inside of the handle case 4*a*, and the switch lever 11 is supported to be able to tilt vertically with respect to the switch base 19. The switch body 12 is turned ON and OFF in response to the operation of the switch lever 11.

The switch body 12 is held between the switch base 19 and the handle case 4*a*, and is positioned at substantially the center of the handle case 4*a*. The switch body 12 is turned ON when an operating knob 12*a* is pushed upward, and is turned OFF when the operating knob 12*a* is protruded downward by a spring biasing force. When the switch body 12 is turned ON, a power supply circuit is turned ON for activating the electric motor 5. In other words, when the switch body 12 is turned ON, the switch body 12 outputs an ON signal to the power supply circuit, so that an electric power is supplied to the electric motor 5. When the switch body 12 is turned OFF, the electric motor 5 is stopped. In other words, when the switch body 12 is turned OFF, the switch body 12 outputs an OFF signal to the power supply circuit, so that no electric power is supplied to the electric motor 5.

Various configurations of the switch lever 11 used for turning ON and OFF the switch body 12, and on-lock and off-lock mechanisms for restricting the movement of the switch lever 11 will now be described.

The switch lever 11 is so supported as to extend in the forward and rearward directions substantially along the lower side of the switch base 19. The switch base 19 is provided with, at the rear portion thereof, a support protrusion portion 19*a* having a semicircular cross section. By way of the support protrusion portion 19*a*, the switch lever 11 is so supported as to be able to tilt in the vertical direction. Between the switch lever 11 and the switch base 19, a compression spring 13 is disposed. By the action of the compression spring 13, the switch lever 11 is biased in the direction to be tilted toward the lower side (the side of the OFF position), i.e., the side opposite to the direction of an arrow C.

When a user grips the handle 4 and operates the switch lever 11 with his or her finger to tilt it toward the upper side, i.e., the side of the ON position, against the action of the compression spring 13, the operating knob 12*a* of the switch body 12 is pushed upward so that the switch body 12 is turned ON. In response to the activation of the switch body 12, the electric motor 5 is activated or started. When the user removes his or her fingertip from the switch lever 11, the switch lever 11 is forced to return to the lower side, i.e., to the OFF position, by the action of the compression spring 13. When the switch lever 11 is returned to the OFF position, the operating knob 12*a* of the switch body 12 protrudes downward so that the switch body 12 is turned OFF. When the switch body 12 is turned OFF, the electric motor 5 is stopped.

The switch lever 11 is provided with both the on-lock and off-lock mechanisms. With the on-lock mechanism, the switch lever 11 is locked in an ON position, and with the off-lock mechanism, the switch lever is locked in an OFF position. These mechanisms share the same lock operation member 15.

The lock operation member 15 is supported at the front side of the switch lever 11. A tip end portion 15*b* of this lock operation member 15 protrudes downward through a window portion 11*b*, which is provided in the lower surface of the switch lever 11. The lock operation member 15 is so supported as to be able to tilt in the forward and rearward directions relative to the switch lever 11 via a shaft portion 15*a*.

This lock operation member 15 is biased by the action of a torsion spring 16 in a counterclockwise direction as viewed in FIG. 2 such that the tip end portion 15*b* moves to the rear side, i.e., the side of the off-lock position. The front upper portion of the lock operation member 15 is integrally provided with an L-shaped engagement protrusion portion 15*c*.

A lock base 17 is attached to the front portion of the switch base 19. This lock base 17 is fixed along the front portion of the switch lever 11 to extend in the vertical direction. At the front lower portion of the lock base 17, a restriction protrusion portion 17*a* is so provided as to protrude forwardly. This restriction protrusion portion 17*a* enters a restriction window portion 11*c* provided at the front portion of the switch lever 11. Within a range allowed for the restriction protrusion portion 17*a* to move in the vertical direction in the restriction window portion 11*c*, the switch lever 11 can tilt in the vertical direction. By way of the restriction protrusion portion 17*a*, the switch lever 11 is restricted with respect to the range for tilting in the vertical direction.

The lock base 17 is integrally provided with, at the lower portion on the rear surface thereof, an engagement protrusion portion 17*b*. Toward this engagement protrusion portion 17*b*, a leaf spring 18 attached to the upper portion of the lock base 17 extends.

With the switch device 10 of the first embodiment configured as described above, in the state that the user is not operating the switch lever 11 at all as shown in FIG. 2, the switch lever 11 is positioned in the OFF position on the lower side by the biasing force of the compression spring 13. In the state that the switch lever 11 is positioned in the OFF position, the lock operation member 15 is kept in the off-lock position where the tip end portion 15*b* is moved to the rear side by the biasing force of the torsion spring 16.

In the state that the lock operation member 15 is positioned in the off-lock position, the engagement protrusion portion 15*c* comes to the lower side of the engagement protrusion portion 17*b* of the lock base 17. Therefore, at this off-lock position, the engagement protrusion portion 15*c* is restricted from being displaced upward by the engagement protrusion portion 17*b* of the lock base 17 so that the switch lever 11 is brought to the off-lock state, where the switch lever 11 cannot be operated to tilt to the side of the ON position (in the direction of arrow C in FIG. 2). With the switch lever 11 being in the off-lock state, the switch lever 11 is prevented from being turned ON accidentally.

For releasing the switch lever 11 from being in the off-lock state, there needs to operate the lock operation member 15 to tilt in the direction of displacing the tip end portion 15*b* thereof toward the front side against the action of the torsion spring 16, i.e., in the off-lock release direction indicated by arrow A. As shown in FIG. 3, when the lock operation member 15 is operated to tilt in the off-lock release direction, the engagement protrusion portion 15*c* thereof moves away from the lower side of the engagement protrusion portion 17*b* of the lock base 17. Accordingly, the switch lever 11 is brought into the state where the switch lever 11 is allowed for operation to be tilted toward the side of the ON position indicated by arrow C. While the lock operation member 15 being held in the state tilted in the off-lock release direction indicated by arrow A, operating the switch lever 11 to tilt toward the ON position on the upper side indicated by arrow C causes the operating knob 12*a* to be pushed, so that the switch body 12 is turned ON, thereby activating the electric motor 5.

While the lock operation member 15 being held to be tilted toward the off-lock release direction, operating the switch lever 11 to tilt from the OFF position toward the ON position causes the engagement protrusion portion 15*c* to pass a position on the rear side of the engagement protrusion portion 17*b* of the lock base 17 and to be displaced upward. When the switch lever 11 has been tilted to the ON position, i.e., the ON state, the engagement protrusion portion 15*c* of the lock operation member 15 slidably contacts with the leaf spring 18. The biasing force of this leaf spring 18 is set to be larger than that of the torsion spring 16. Therefore, in this stage, even if the operation of tilting the lock operation member 15 in the off-lock release direction is stopped, the lock operation member 15 is held in the off-lock release position, i.e., the position shown in FIG. 3, due to the biasing force of the leaf spring 18.

When the user stops the operation of tilting the switch lever 11 to the side of the ON position using his or her fingertip, the switch lever 11 is forced to return to the OFF position on the lower side by the action of the compression spring 13. When the switch lever 11 has returned to the OFF position on the lower side, the engagement protrusion portion 15*c* of the lock operation member 15 passes a position on the rear side of the engagement protrusion portion 17*b* of the lock base 17. Because the lock operation member 15 is being biased toward the off-lock side by the action of the torsion spring 16, in response to the tilting movement of the switch lever 11 to the side of the OFF position, the lock operation member 15 returns to the off-lock position as the engagement protrusion portion 15*c* passes a position on the rear side of the engagement protrusion portion 17*b*. In the state that the lock operation member 15 has returned to the off-lock position as described above, the switch lever 11 is not allowed to be tilted toward the side of the ON position (in the direction of arrow C). This function may be called an off-lock function.

In addition to the off-lock function, the switch device 10 of this embodiment has an on-lock function. As shown in FIG. 3, by tilting the switch lever 11 toward the ON position indicated by arrow C while the lock operation member 15 being held to be tilted toward the off-lock release position indicated by arrow A, the switch body 12 is turned ON so that the electric motor 5 can be activated. Thereafter, as shown in FIG. 4, the lock operation member 15 is operated to tilt to the side of the on-lock position indicated by arrow B, i.e., in the direction of displacing the tip end portion 15*b* thereof to the rear side. With this on-lock operation, the user's operation force of tilting the lock operation member 15 and the biasing force of the torsion spring 16 may exceed the biasing force of the leaf spring 18 so that the engagement protrusion portion 15*c* reaches to a position above the engagement protrusion portion 17*b* while pushing the leaf spring 18 to the front side. As a result, when the tilting operation of the switch lever 11 to the side of the ON position is stopped with the lock operation member 15 held in the on-lock position, the biasing force of the compression spring 13 applied to the switch lever 11 acts to press from above the engagement protrusion portion 15*c* to engage it with the engagement protrusion portion 17*b* of the lock base 17. With this engagement from above of the engagement protrusion portion 15*c* of the lock operation member 15 with the engagement protrusion portion 17*b* of the lock base 17, the switch lever 11 is restricted from tilting to the side of the OFF position. Because the switch lever 11 is held in the ON position with the restriction not to tilt to the side of the OFF position, the switch body 12 is held in the ON state so that the electric motor 5 is locked in the state of activation. With the switch lever 11 being locked in the ON position, the user no more needs to pull the switch lever 11 for locking the electric motor 5 in the state of activation, so that he or she can comfortably performs the grinding operation by gripping the handle 4.

In the on-lock state of the switch lever 11, if the user grips upward the switch lever 11 again for operation, the engagement protrusion portion 15*c* of the lock operation member 15 moves away upward with respect to the engagement protrusion portion 17*b* of the lock base 17. This accordingly causes the engagement protrusion portion 15*c* to be pushed to the rear side by the biasing force of the leaf spring 18, and in response thereto, the lock operation member 15 is tilted in the direction of displacing the tip end portion 15*b* thereof to the front side against the action of the torsion spring 16, i.e., in the direction of arrow A in FIG. 3. In this way, because the lock operation member 15 returns to the position shown in FIG. 3, if the user releases the switch lever 11 from his or her griping operation, the switch lever 11 returns to the OFF position on the lower side by the action of the compression spring 13, so that the switch body 12 is turned OFF. Moreover, the lock operation member 15 returns to the off-lock position where the tip end portion 15*b* thereof is displaced to the rear side by the biasing force of the torsion spring 16, and accordingly the switch device 10 returns to the off-lock state, i.e., initial state.

As described above, with the switch device 10 of the first embodiment, tilting the lock operation member 15 in the off-lock release direction indicated by arrow A enables to release the switch lever 11 from being in the off-lock state. Moreover, with the switch lever 11 held in the ON position, tilting the lock operation member 15 in the on-lock direction indicated by arrow B enables to change the state of the switch lever 11 into the on-lock state. Therefore, the operation direction of the lock operation member 15 to release the switch lever 11 from being in the off-lock state, i.e., in the direction of arrow A, is opposite to the operation direction of the lock operation member 15 to change the state of the switch lever 11 into the on-lock state, i.e., in the direction of arrow B. This difference in direction can prevent an accidental operation, in which, after the lock operation member 15 is operated to tilt in the off-lock release direction indicated by arrow A, the lock operation member 15 is operated continuously to tilt in the same direction and thus bringing the switch lever 11 into the on-lock state. Thus, in order to change the state of the switch lever 11 into the on-lock state, the lock operation member 15 is required to be operated to tilt in the opposite direction, i.e., in the direction indicated by arrow B, so that the user's intended operation can be reliably reflected.

Second to sixth embodiments will now described with reference to FIGS. 5 to 27. These embodiments are modifications of the first embodiment. Therefore, in FIGS. 5 to 27, like members are given the same reference numerals as the first embodiment and an explanation of these members will not be repeated.

Second Embodiment

Figure 5:
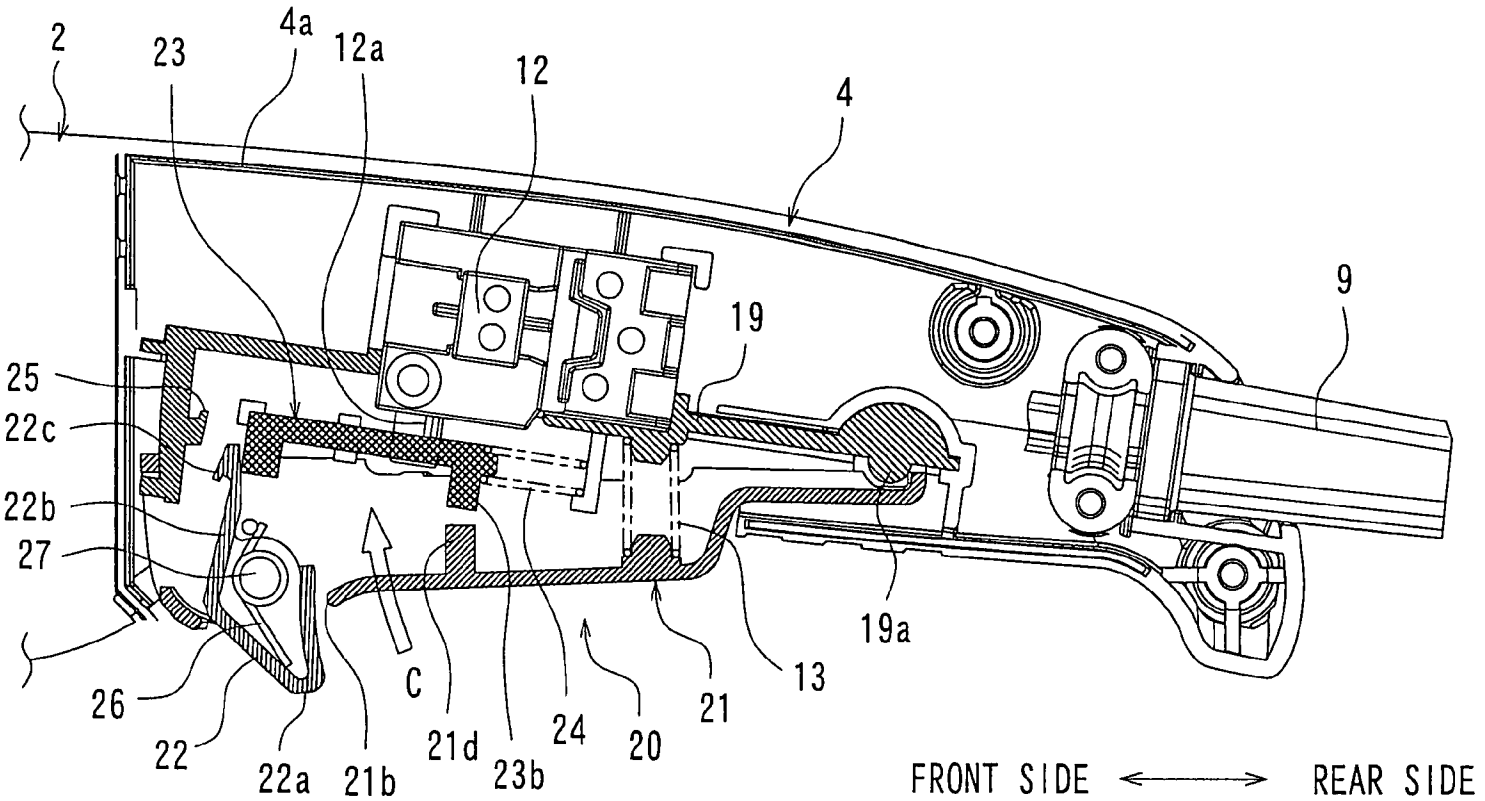
FIG. 5 is a vertical sectional view of a handle including a switch device according to a second embodiment of the present invention, and showing an off-lock state of the switch device.
Figure 6:
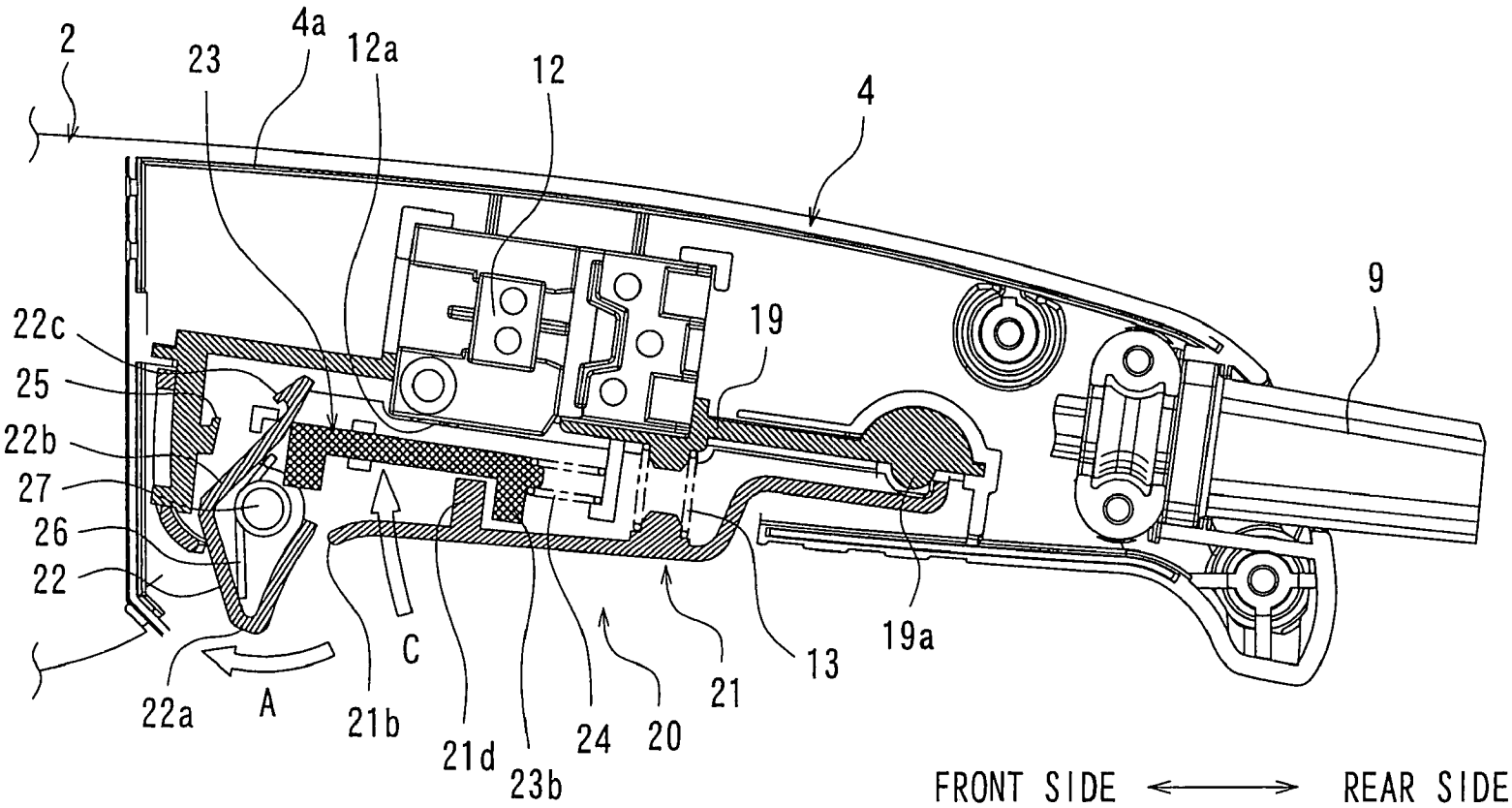
FIG. 6 is another vertical sectional view of the handle including the switch device of the second embodiment, and showing the state where the switch is released from the off-lock state and a switch lever is operated to tilt toward an ON position.
Figure 7:
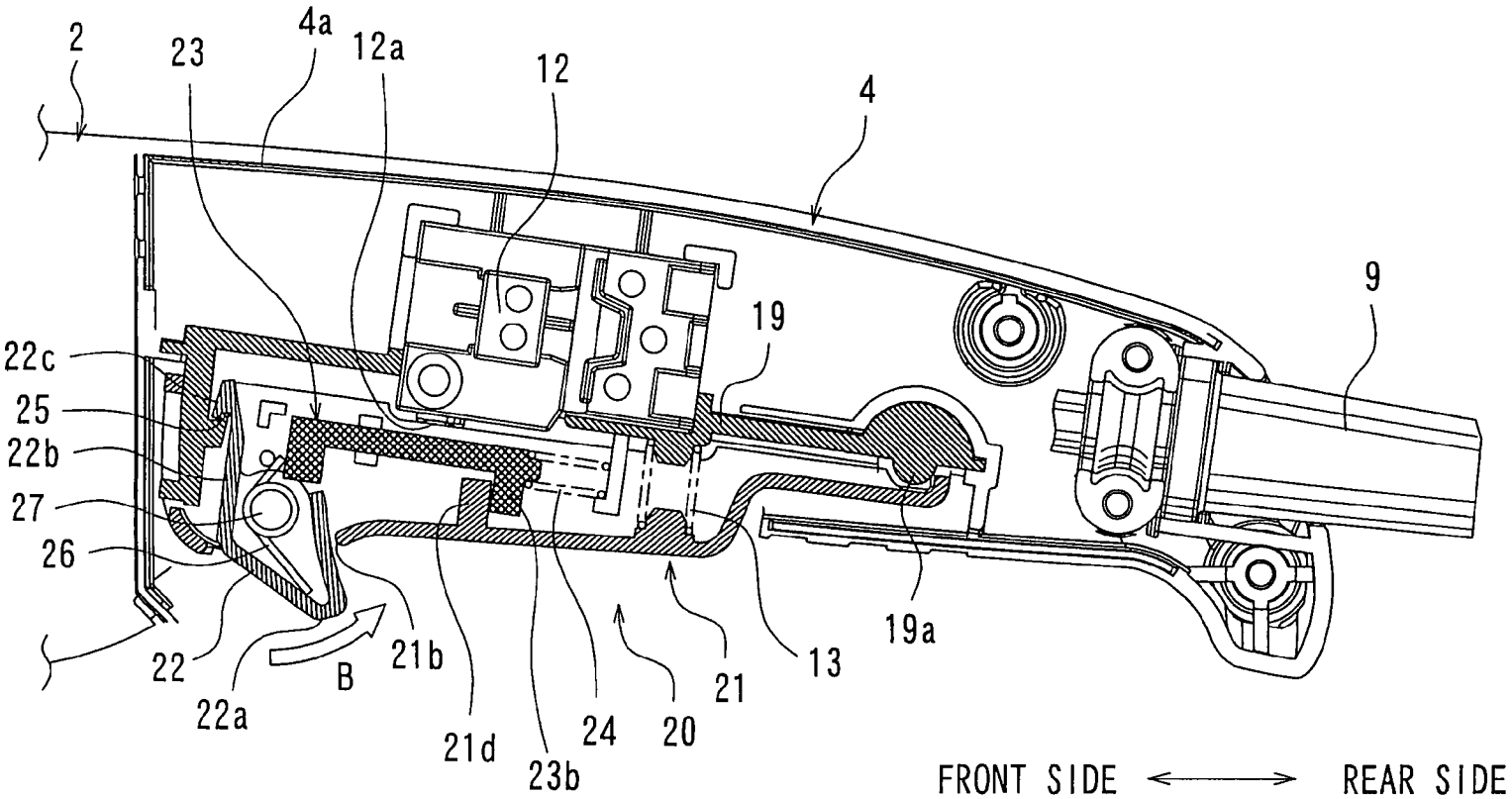
FIG. 7 is a further vertical sectional view of the handle including the switch device of the second embodiment and showing an off-lock state of the switch device.

FIGS. 5 to 7 show a switch device 20 according to the second embodiment. In the first embodiment, the engagement protrusion portion 15*c* provided at the lock operation member 15 serves to perform both the on-lock and off-lock functions, but in the second embodiment, these functions are performed by a different mechanism from the engaging protrusion 15*c*.

Similarly to the first embodiment, a switch lever 21 is supported to be able to tilt in the vertical direction between the upper ON position and the lower OFF position by way of the support protrusion portion 19*a*. The support protrusion portion 19*a* is disposed at the rear portion of the switch base 19. The switch lever 21 is biased in the direction of moving toward the lower OFF position by the action of the compression spring 13, which is disposed between the switch lever 21 and the switch base 19.

On the front lower surface of the switch lever 21, a lock operation member 22 is so supported as to be able to tilt in the forward and rearward directions via a shaft 27. A tip end portion 22*a* of this lock operation member 22 protrudes downward through a window portion 21*b*, which is provided at the front portion of the switch lever 21. This lock operation member 22 is biased by the action of a torsion spring 26 in the direction of displacing the tip end portion 22*a* toward the front side, i.e., clockwise direction in FIG. 5. In this respect, the biasing direction of the torsion spring 26 is opposite to that of the torsion spring 16 of the first embodiment.

The lock operation member 22 is integrally provided with, on the upper portion thereof, an engagement arm portion 22*b* that extends upward. The tip end portion of this engagement arm portion 22*b* is provided with an engagement portion 22*c* that is bent into an L shape. On the rear side of the engagement arm portion 22*b*, a slider 23 is disposed. This slider 23 is supported by the switch base 19 in such a manner that it can slide in the forward and rearward directions. Between a rear engagement portion 23*b* of this slider 23 and the switch base 19, a compression spring 24 is disposed. By the action of this compression spring 24, the slider 23 is biased in the direction of displacing toward the front side.

The biasing force of the compression spring 24 is set to be larger than that of the torsion spring 26, which serves to bias the lock operation member 22 in the clockwise direction. Therefore, the engagement arm portion 22*b* of the lock operation member 22 is pushed toward the front side by the slider 23 so that the lock operation member 22 is biased in the direction of displacing the tip end portion 22*a* thereof toward the rear side against the action of the torsion spring 26, i.e., toward the side of the off-lock position.

The inner surface of the switch lever 21 located below the slider 23 is integrally provided with an engagement protrusion portion 21*d*. This engagement protrusion portion 21*d* is formed like a column extending upward. As shown in FIG. 5, this engagement protrusion portion 21*d* is located below the rear engagement portion 23*b* of the slider 23 in the state that the slider 23 has moved toward the front side.

The front portion of the switch base 19 is provided with an engagement protrusion portion 25, which is bent into an L shape. This engagement protrusion portion 25 protrudes upward of the lock operation member 22.

As shown in FIG. 5, in the state that the user grips the handle 4 but does not operate the switch lever 21, the switch lever 21 is positioned in the OFF position on the lower side by the action of the compression spring 13. If the lock operation member 22 is not operated when the switch lever 21 is positioned in the OFF position, the lock operation member 22 is held in the off-lock position where the tip end portion 22*a* thereof is displaced to the rear side by the engagement arm portion 22*b* that is pushed toward the front side by the slider 23. In the state that the lock operation member 23 is positioned in the off-lock position, the engagement protrusion portion 21*d* is positioned directly below the rear engagement portion 23*b* of the slider 23. A space between the rear engagement portion 23*b* and the engagement protrusion portion 21*d* is set to be very narrow. Accordingly, the switch lever 21 is in the off-lock state in which the tilting operation toward the ON position indicated by arrow C in FIG. 5 is restricted.

For releasing the switch lever 21 from the off-lock state, the lock operation member 22 must be tilted in the off-lock release direction indicated by arrow A in FIG. 6. When the lock operation member 22 is operated to tilt in the off-lock release direction, the sum of the operation force of tilting the lock operation member 22 and the biasing force of the torsion spring 26 may exceed the biasing force of the compression spring 24 so that the slider 23 moves toward the rear side against the biasing force of the compression spring 24.

When the slider 23 is moved toward the rear side, the rear engagement portion 23*b* thereof is moved away from the upper side of the engagement protrusion portion 21*d* toward the rear side, whereby the switch lever 21 can be operated to tilt toward the side of the ON position indicated by tarrow C. As the switch lever 21 is operated to tilt toward the ON position, the operating knob 12*a* of the switch body 12 is pushed by the switch lever 21 and the switch body 12 is turned ON, thereby activating the electric motor 5. As shown in FIG. 6, when the switch lever 21 is operated to tilt toward the ON position, the engagement protrusion portion 21*d* thereof comes to the front side of the rear engagement protrusion portion 23*b* of the slider 23. Therefore, the slider 23 is restricted from moving toward the front side.

In the state that the lock operation member 22 is positioned in the off-lock release position by operating the switch lever 21 to tilt toward the ON position, if the user stops the operation of tilting the switch lever 21 toward the ON position, the switch lever 21 returns to the OFF position again by the action of the compression spring 13 and the switch body 12 is thus turned OFF, thereby stopping the electric motor 5.

On the other hand, as shown in FIG. 7, if the lock operation member 22 is operated to tilt toward the on-lock position indicated by arrow B against the action of the torsion spring 26 in the state where the switch lever 21 has been tilted to the ON position, the engagement portion 22*c* thereof is displaced to be positioned above the engagement protrusion portion 25 on the side of the switch base 19. Therefore, by the engagement of the engagement portion 22*c* from above with the engagement protrusion portion 25, the lock operation member 22 is held in the on-lock position of FIG. 7, and the switch lever 21 is locked in the ON position while the tilting movement toward the side of the OFF position being restricted (on-lock state).

If the switch lever 21 in the on-lock state is operated to tilt further, the engagement portion 22*c* is disengaged from the engagement protrusion portion 25 because the lock operation member 22 is biased toward the side of the off-lock position by the action of the torsion spring 26. As a result, the switch lever 21 returns toward the side of the OFF position by the action of the compression spring 13. When the switch lever 21 returns toward the side of the OFF position, the engagement protrusion portion 21*d* is moved away from the front side of the rear engagement portion 23*b*, thereby causing movement of the slider 23 toward the front side by the action of the compression spring 24.

Moreover, because the engagement portion 22*c* of the lock operation member 22 is disengaged from the engagement protrusion portion 25, the lock operation member 22 returns again to the direction of displacing the tip end portion 22*a* thereof toward the front side, i.e., in the clockwise direction. In addition, the engagement arm portion 22*b* of the lock operation member 22 is pushed by the slider 23 toward the front side, and the lock operation member 22 returns to the off-lock position shown in FIG. 5 so that the switch lever 21 is locked in the OFF position.

Also with the switch device 20 of the second embodiment configured as described above, the off-lock release direction (direction of arrow A) of the lock operation member 22 is opposite to the operation direction for changing the state of the switch lever 21 into the on-lock state (direction of arrow B).

This difference in direction can prevent an accidental operation, in which, after the lock operation member 22 is operated to tilt in the off-lock release direction indicated by arrow A, the lock operation member 22 is operated continuously to tilt in the same direction and thus bringing the switch lever 21 into the on-lock state. Thus, in order to change the state of the switch lever 21 into the on-lock state, the lock operation member 22 is required to be operated to tilt in the opposite direction, i.e., direction indicated by arrow B, and thus the user's intended operation can be reliably reflected.

Third Embodiment

FIGS. 8 to 11 show a switch device 30 according to a third embodiment of the present invention. Similar to the switch device 10 of the first embodiment, the switch device 30 of the third embodiment is configured such that a single piece of a lock operation member 32 can be operated for releasing the off-lock state and for changing into the on-lock state.

The lock operation member 32 is supported at the front portion of a switch lever 31 via a shaft 33. This lock operation member 32 can tilt in the forward and rearward directions about the shaft 33. The lock operation member 32 is biased in the direction of displacing its tip end portion 32*d* toward the rear side (side of the off-lock position) by the action of a compression spring 35, which is disposed between the front portion of the lock operation member 32 and a spring support portion 31*a* of the switch lever 31.

The lock operation member 32 is provided with a first engaging arm 32*a* and a second engagement arm 32*b*. The first engagement arm 32*a* extends upward. The upper portion of the first engagement arm 32*a* is provided with an engagement portion 32*c*, which is bent forwardly into an L shape.

Figure 8:
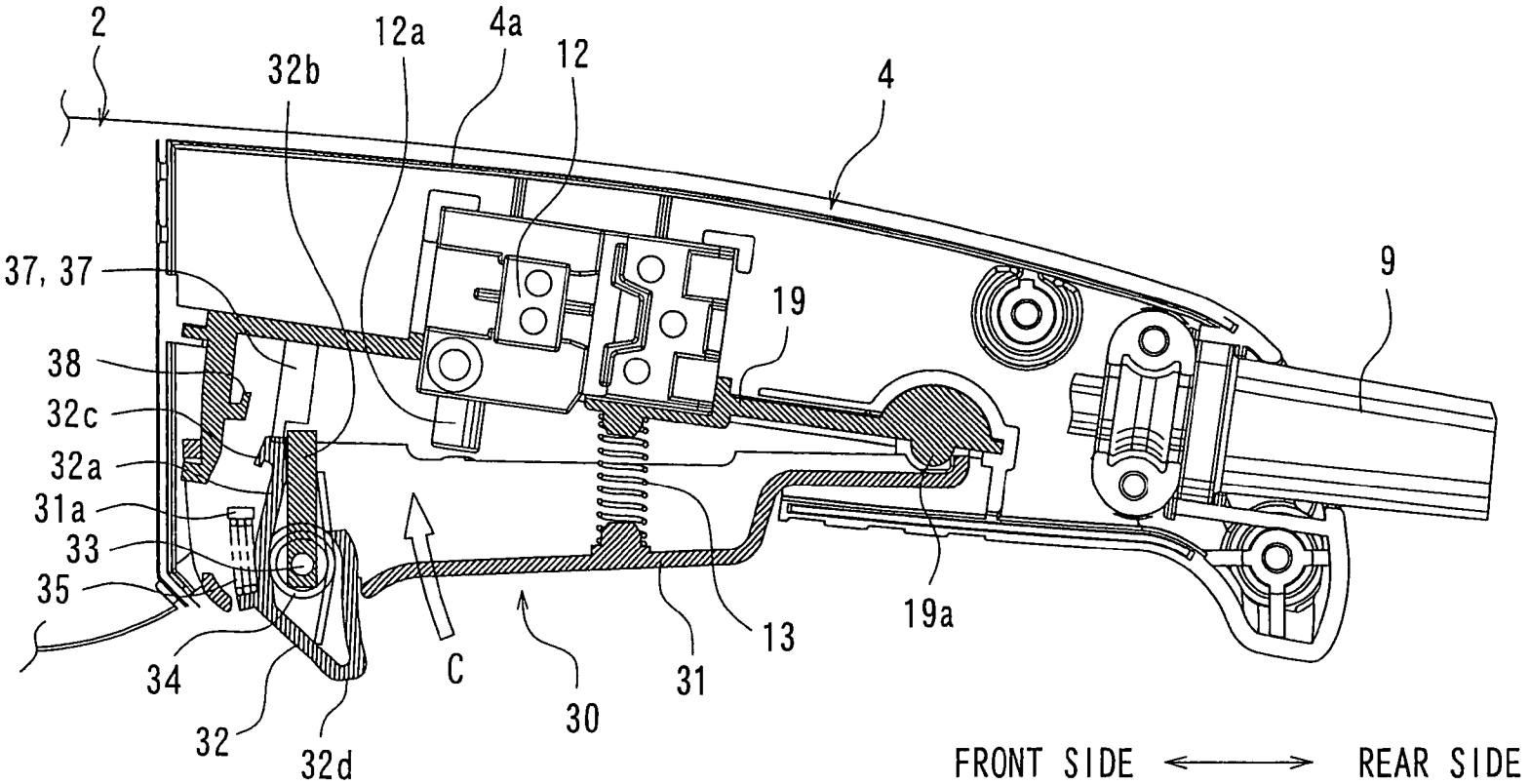
FIG. 8 is a vertical sectional view of a handle including a switch device according to a third embodiment of the present invention and showing an off-lock state of the switch device.
Figure 11:
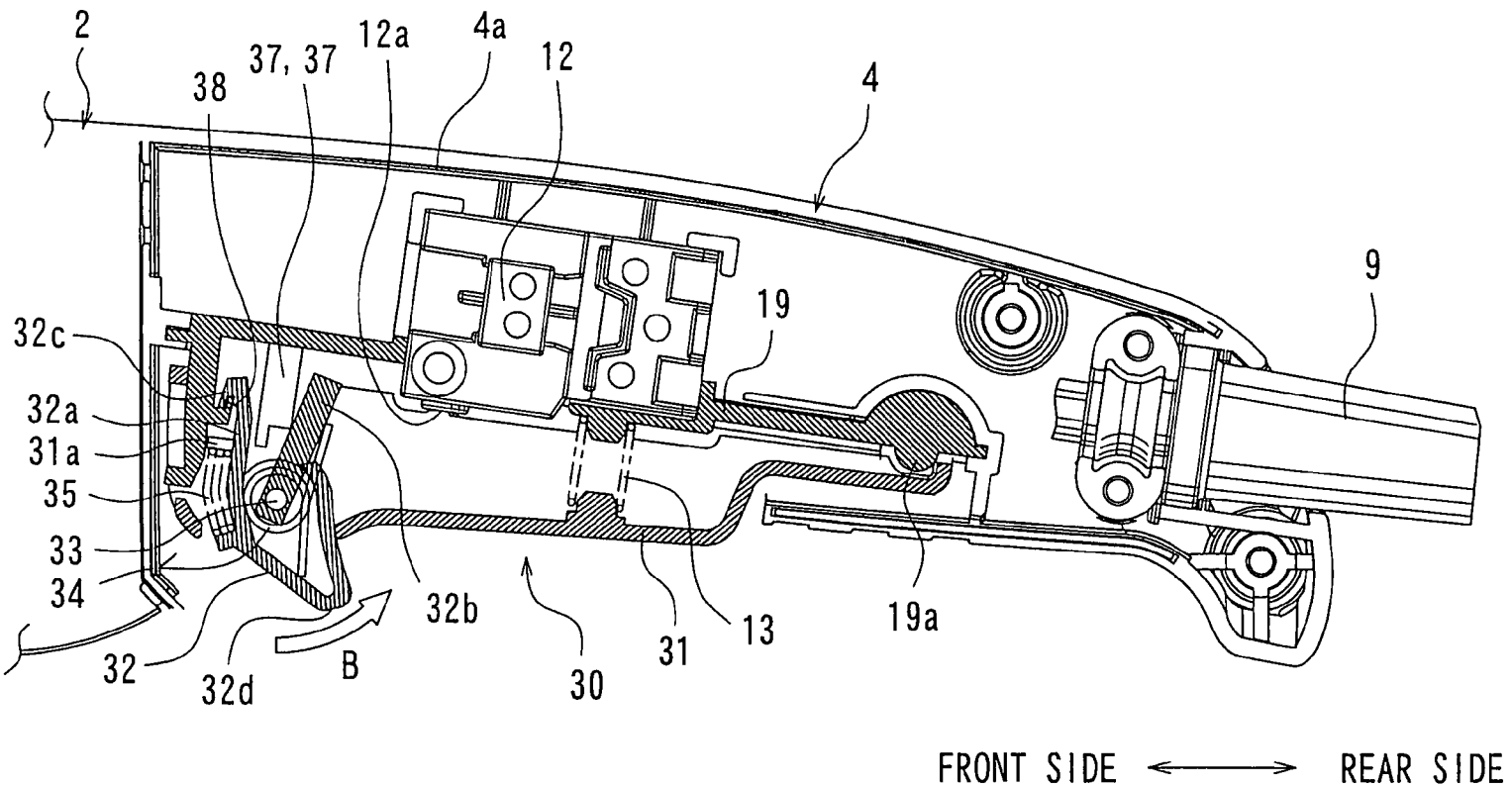
FIG. 11 is a further vertical sectional view of the handle including the switch device of the third embodiment and showing an on-lock state of the switch device.
Figure 12:
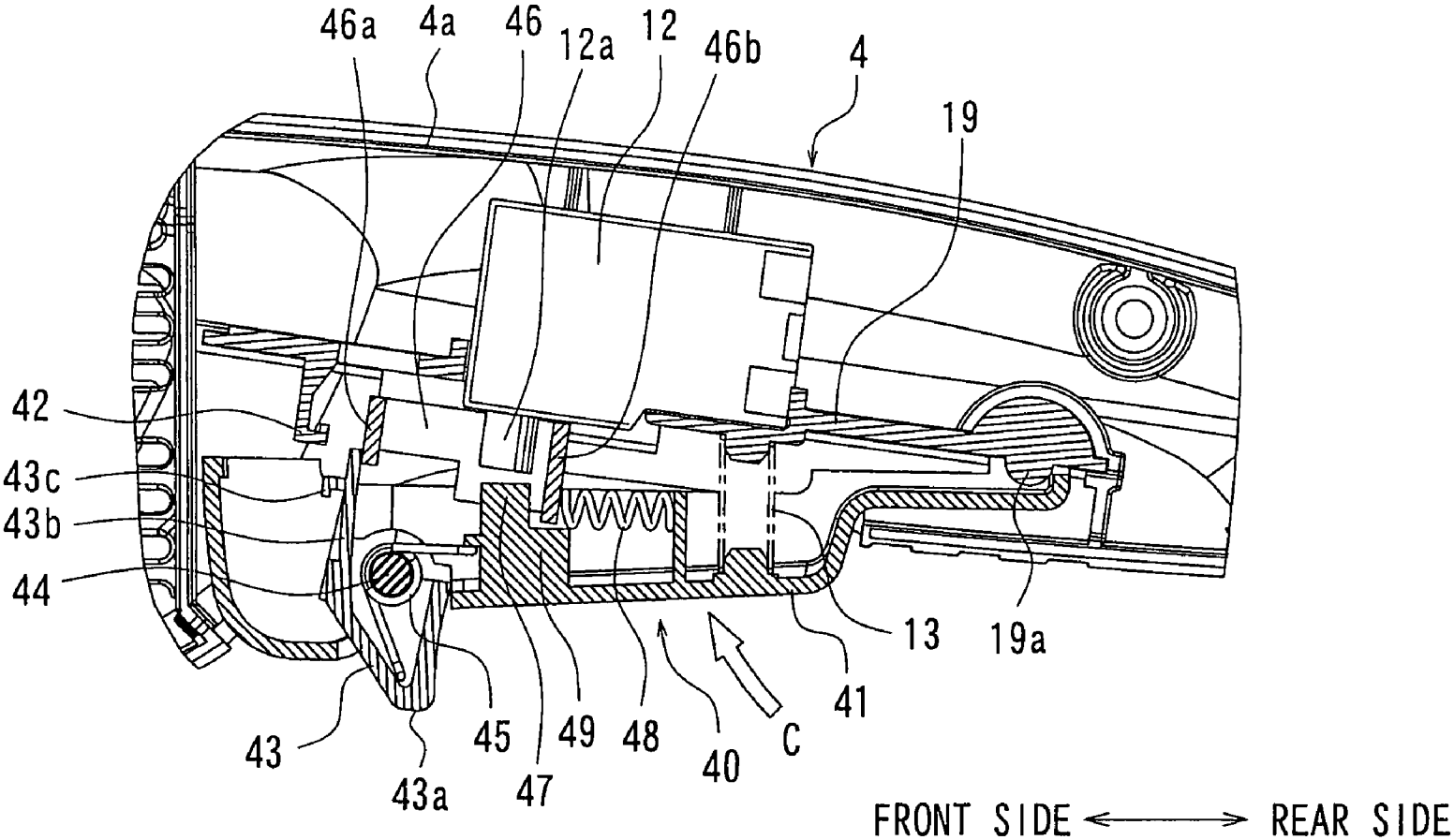
FIG. 12 is a vertical sectional view of a handle including a switch device according to a fourth embodiment of the present invention and showing an off-lock state of the switch device.

The second engagement arm 32*b* is so supported as to be able to tilt in the forward and rearward directions via the shaft 33. This second engagement arm 32*b* is biased in the direction of displacing the front portion thereof toward the front side by the action of a torsion spring 34. The second engagement arm 32*b* is so disposed as to extend upward along the rear side of the first engagement arm 32*a*. As shown in FIG. 8, this second engagement arm 32*b* is held in a position along the rear side of the first engagement arm 32*a* by the action of the torsion spring 34. Moreover, as shown in FIG. 11, the second engagement arm 32*b* is allowed to tilt in the direction of displacing the upper portion thereof toward the rear side, i.e., direction of moving away from the first engagement arm 32*a*, against the action of the torsion spring 34.

As shown in FIG. 8, the switch lever 31 is held in the OFF position by the spring biasing force of the compression spring 13 when it is not pulled for operation. The lock operation member 32 is held in the off-lock position by the spring biasing force of the compression spring 35 when it is not operated. In the state that the lock operation member 32 is positioned in the off-lock position, above the second engagement arm 32*b*, two engagement protrusion portions 37 are located. These two engagement protrusion portions 37 are integrated with the switch base 19, and a space between the second engagement arm 32*b* and the engagement protrusion portions 37 is set to be very narrow. Therefore, when the lock operation member 32 is not operated, the switch lever 31 is held in the off-lock state in which the switch lever 31 is restricted not to be operated toward the side of the ON position.

Figure 9:
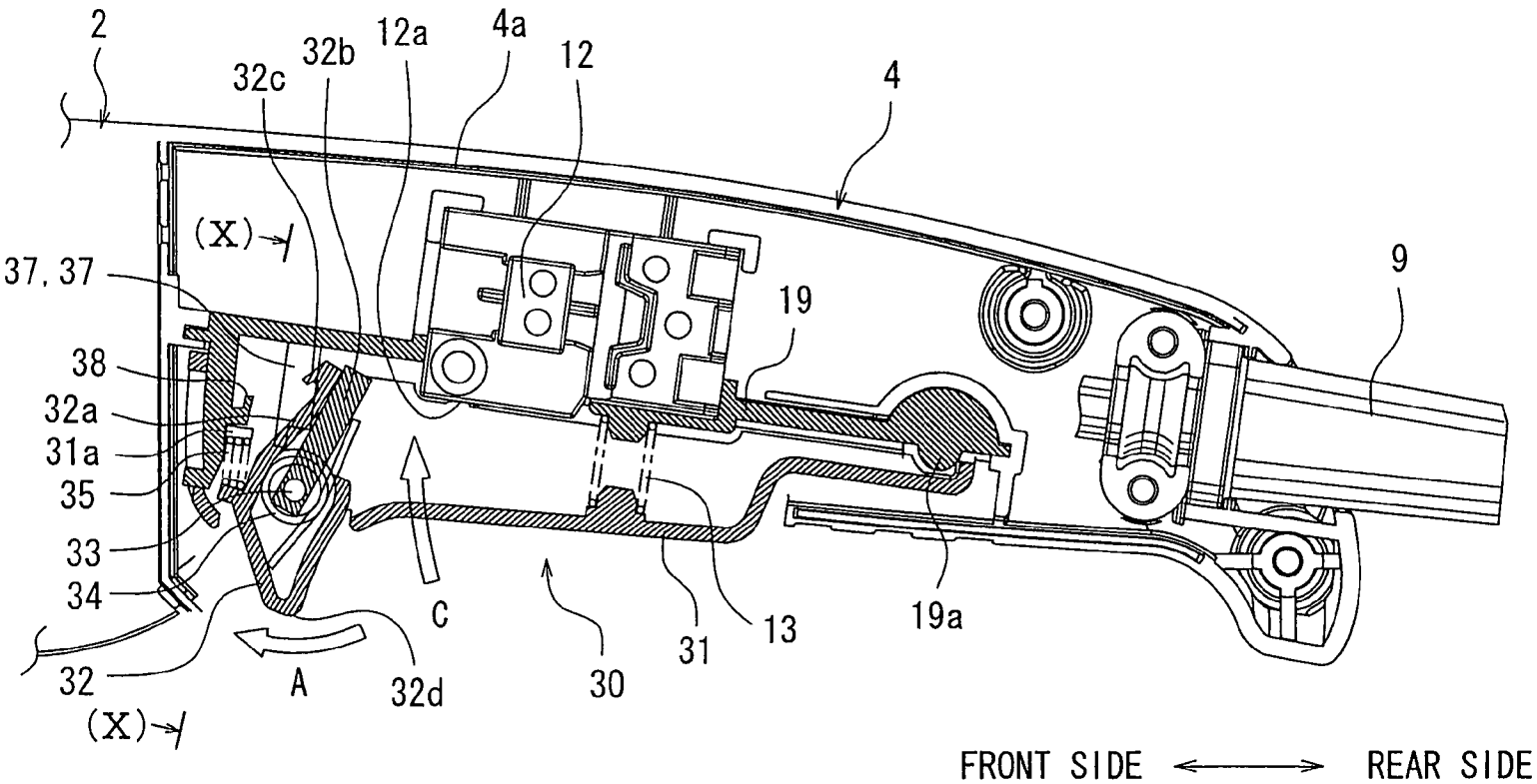
FIG. 9 is another vertical sectional view of the handle including the switch device of the third embodiment, and showing the state where the switch is released from the off-lock state and a switch lever is operated to tilt toward an ON position.

In order to pull the switch lever 31 to the side of the ON position, the lock operation member 32 is operated to tilt in the off-lock release direction indicated by arrow A in FIG. 9, so that the first and second engagement arms 32*a* and 32*b* are tilted together in the direction of displacing the upper portions thereof toward the rear side. Such a tilting operation of the lock operation member 32 in the off-lock release direction is made against the action of the compression spring 35.

If the lock operation member 32 is operated to tilt in the off-lock release direction, the tip end portion of the second engagement arm 32*b* is displaced toward the rear side of the engagement protrusion portions 37 so that the switch lever 31 is allowed for tilting toward the side of the ON position. If the switch lever 31 is operated to tilt toward the ON position, similar to the first embodiment, the operating knob 12*a* is pushed and the switch body 12 is turned ON, thereby activating the electric motor 5.

Figure 10:
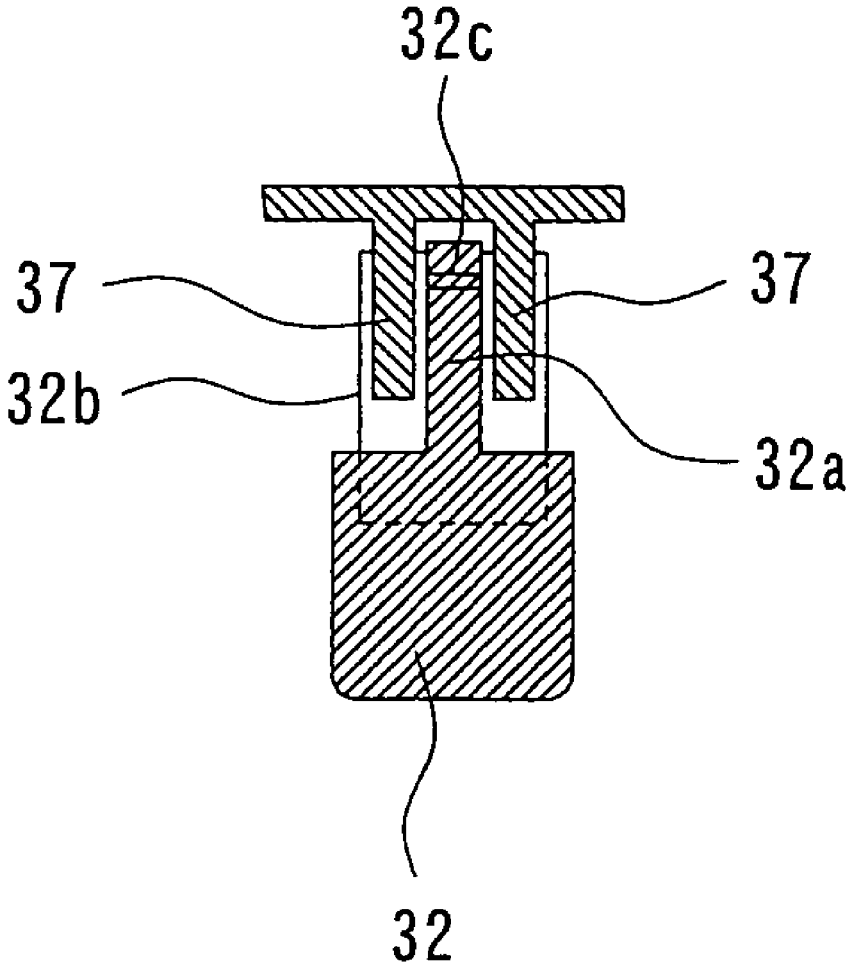
FIG. 10 is a cross sectional view of the handle taken along line X-X in FIG. 9 and showing the positional relationship between a lock operation member in the off-lock position and an engagement protrusion portion as viewed from the front side.

As shown in FIG. 10, the two engagement protrusion portions 37 are so disposed as to separately protrude downward while they are spaced from each other in their width direction, i.e., in the right and left directions in FIG. 10. The first engagement arm 32*a* on the front side is set to have a narrow width so as to be capable of entering the space between the engagement protrusion portions 37. On the other hand, the second engagement arm 32*b* on the rear side is set to have a broad width so as to be opposed to and extend between the engagement protrusion portions 37. Accordingly, as shown in FIG. 9, if the switch lever 31 is operated to tilt toward the side of the ON position in the state that the lock operation member 32 has been tilted in the off-lock release direction, the first engagement arm 32*a* enters into the space between the engagement protrusion portions 37 and causes no interference therewith. On the other hand, if the switch lever 31 is operated to tilt toward the ON position while the switch lever 31 being in the off-lock release state, both of the engagement protrusion portions 37 come in contact with the front surface of the second engagement arm 32*b*, thereby restricting the second engagement arm 32*b* from tilting toward the front side. Because the second engagement arm 32*b* is restricted not to tilt toward the front side, as shown in FIG. 11, the operation of tilting the lock operation member 32 in the direction of arrow B is made against the biasing force of the torsion spring 34.

As shown in FIG. 11, in the state that the switch lever 31 has been tilted to the ON position, if the lock operation member 32 is tilted in the direction of arrow B against the biasing force of the torsion spring 34, the first engagement arm 32*a* is tilted toward the front side so that the engagement portion 32*c* thereof is engaged with an engagement protrusion 38 that is provided integrally with the switch base 19. With the engagement portion 32*c* of the first engagement arm 32*a* engaged with the engagement protrusion 38, the lock operation member 32 is locked in the on-lock position of FIG. 11, and thus the switch lever 31 is locked in the ON position.

If the switch lever 31 in the on-lock state is gripped more firmly, the first engagement arm 32*a* is disengaged from the engagement protrusion 38. Therefore, the lock operation member 32 returns to the position shown in FIG. 9 by the biasing force of the torsion spring 34 so that the switch lever 31 is released from the on-lock state. Therefore, releasing the pulling operation of the switch lever 31 causes the switch lever 31 to return to the OFF position by the biasing force of the compression spring 13.

As described above, also with the switch device 30 of the third embodiment configured as described above, the operation direction of the lock operation member 31 for releasing it from the off-lock state (the direction of arrow A) is opposite to the operation direction thereof for changing the state of the switch lever 31 into the on-lock state (the direction of arrow B). This difference in direction allows the user to clearly distinguish between the off-lock release operation and the on-lock switching operation so that the switch device 30 can reliably reflect the user's intention in terms of operation.

Fourth Embodiment

Next, FIGS. 12 to 15 show a switch device 40 according to a fourth embodiment of the present invention. The switch device 40 is configured to include the switch base 19, a switch lever 41, and the switch body 12. The switch lever 41 is supported to be able to tilt in the vertical direction between the OFF and ON positions via the support protrusion portion 19*a*, which is provided at the rear portion of the switch base 19. On the front portion of this switch lever 41, a lock operation member 43 is so supported as to be able to tilt in the forward and rearward directions via a shaft 44. This lock operation member 43 is biased by the action of a torsion spring 45 in the direction of displacing a tip end portion 43*a* toward the front side. The lock operation member 43 is provided with an on-lock arm 43*b*. On the other hand, on the lower surface side of the switch base 19, a slider 46 having a rectangular frame-like shape is so supported as to be able to slide in the forward and rearward directions. This slider 46 is biased toward the front side by a compression spring 48, which is disposed between the slider 46 and the switch lever 41.

By the biasing force of the torsion spring 45, the on-lock arm 43*b* of the lock operation member 43 is pressed toward the rear side against a front frame portion 46*a* of the slider 46. On the other hand, the slider 46 is biased toward the front side by the action of the compression spring 48. The pressing force toward the rear side of the on-lock arm 43*b* against the slider 46, i.e., the biasing force of the torsion spring 45, is set to be smaller than the biasing force of the compression spring 48 applied from the rear side. With such a setting, a biasing force that is subtraction of the biasing force of the torsion spring 45 from that of the compression spring 48 acts on the lock operation member 43 in the counterclockwise direction so that the lock operation member 43 is held in the off-lock position shown in FIG. 12.

The inner surface of the switch lever 41 located below the slider 46 is integrally provided with first and second protrusion portions 47 and 49 that extend upward. The first protrusion portion 47 extends to a position opposed to the operating knob 12*a* of the switch body 12 with a small space. The second protrusion portion 49 is so formed as to be shorter (lower as viewed in FIG. 12) than the first protrusion portion 47.

In the state that the switch lever 41 is positioned in the OFF position and the lock operation member 43 is held in the off-lock position, the rear frame portion 46*b* of the slider 46 comes above the second protrusion portion 49, and therefore, the switch lever 41 is not allowed to be tilted toward the side of the ON position. This corresponds to the off-lock state.

Figure 13:
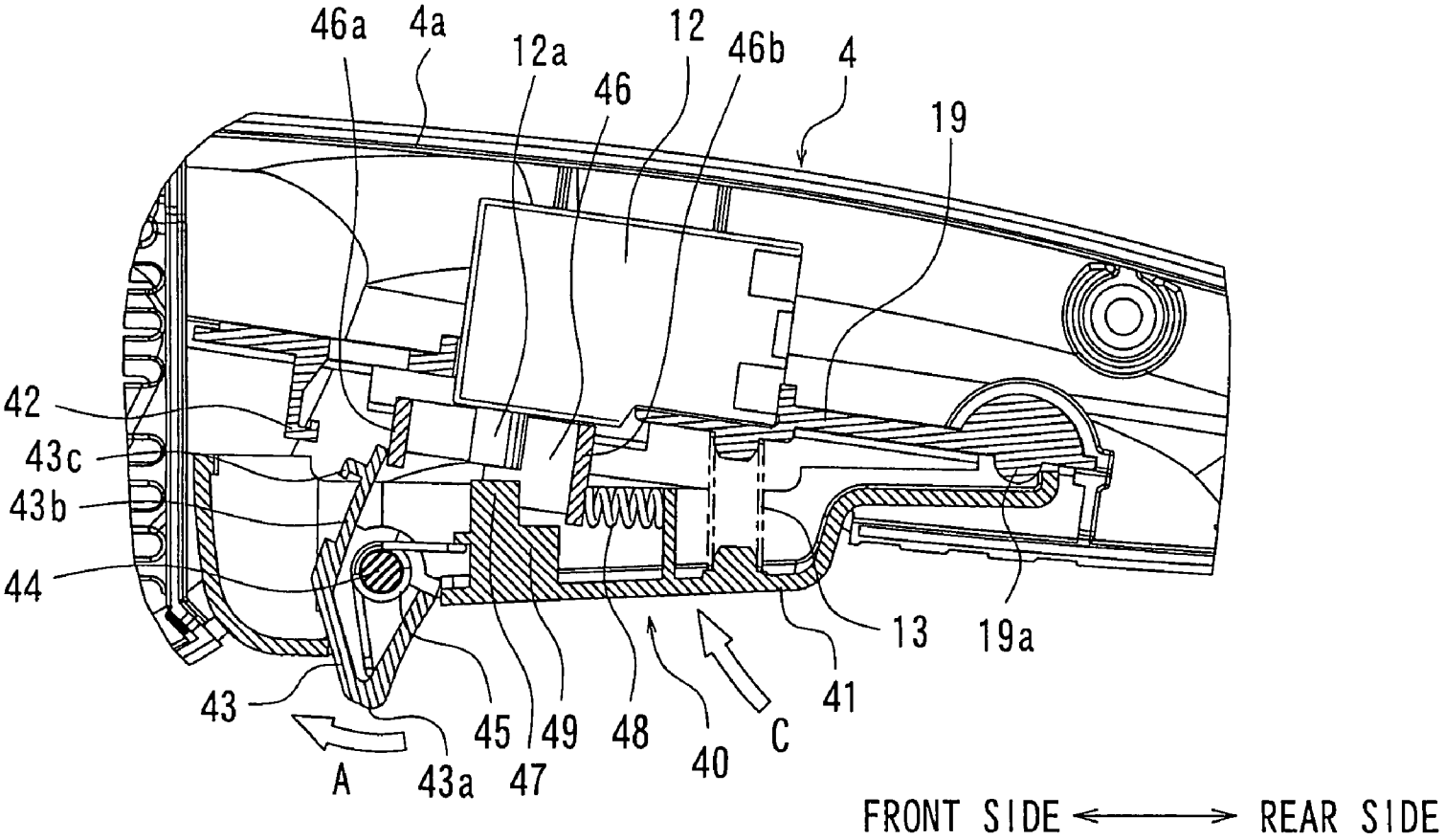
FIG. 13 is another vertical sectional view of the handle including the switch device of the fourth embodiment, and showing the state in which the switch is released from the off-lock state and a switch lever is positioned in an OFF position.
Figure 14:
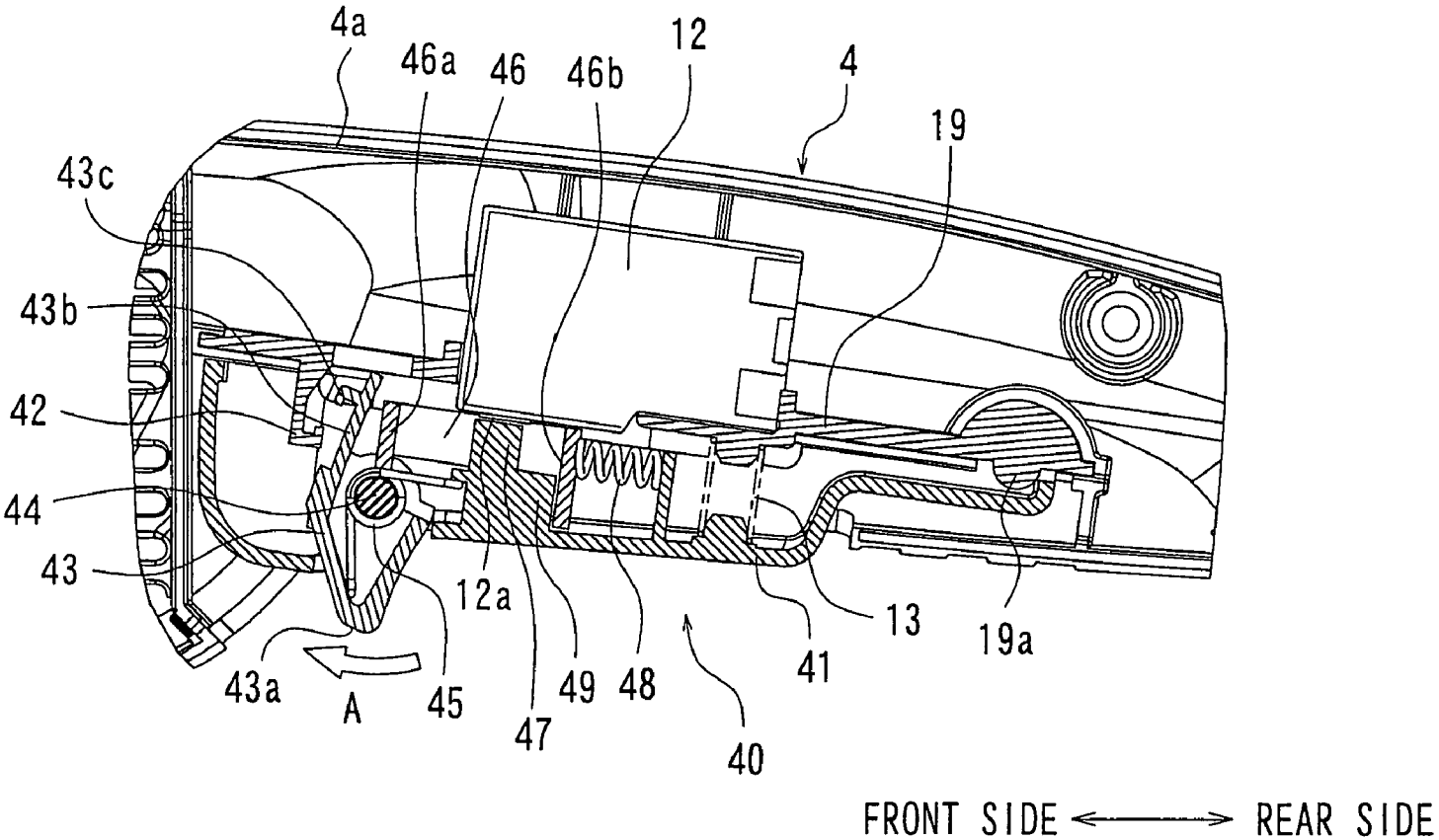
FIG. 14 is a further vertical sectional view of the handle including the switch device of the fourth embodiment, and showing the state where the switch lever is tilted toward the ON position.

As shown in FIG. 13, if the lock operation member 43 is operated to tilt toward the off-lock release side, i.e., in the direction of arrow A, causing the tip end portion 43*a* thereof to be displaced toward the front side, the operating force of the lock operation member 43 acts on the slider 46 via the on-lock arm 43*b* so that the slider 46 is pushed toward the rear side against the action of the compression spring 48. As the slider 46 is displaced toward the rear side, the rear frame portion 46*b* is moved toward the rear side from the above of the second protrusion portion 49 so that the switch lever 41 is allowed to be tilted toward the side of the ON position. As shown in FIG. 14, if the switch lever 41 is operated to tilt toward the ON position, the operating knob 12*a* of the switch body 12 is pushed by the first protrusion portion 47 so that the switch body 12 is turned ON and the electric motor 5 is activated.

In the state that the switch lever 41 has been tilted to the ON position, the switch lever 41 is held in the off-lock release state even in the case that the operation of tilting the lock operation member 43 in the direction of arrow A is stopped. This is because the lock operation member 43 is biased by the action of the torsion spring 45, and thus the second protrusion portion 49 enters the front side of the rear frame portion 46*b* of the slider 46 to thereby restrict the slider 46 from moving toward the front side. In this off-lock release state, if the turn-ON operation of the switch lever 41 is released, the switch lever 41 returns to the OFF position by the action of the compression spring 13. As the switch lever 41 returns to the OFF position, the second protrusion portion 49 moves downward away from the front side of the rear frame portion 46*b* of the slider 46. Therefore, the slider 46 returns to the front side by the biasing force of the compression spring 48.

As the slider 46 returns toward the front side, the rear frame portion 46*b* is brought to be positioned above the second protrusion portion 49, and the on-lock arm 43*b* is pushed toward the front side by the front frame portion 46*a* so that the lock operation member 43 returns to the off-lock position against the action of the torsion spring 45. As a result, the switch lever 41 returns to the off-lock state shown in FIG. 14.

Figure 15:
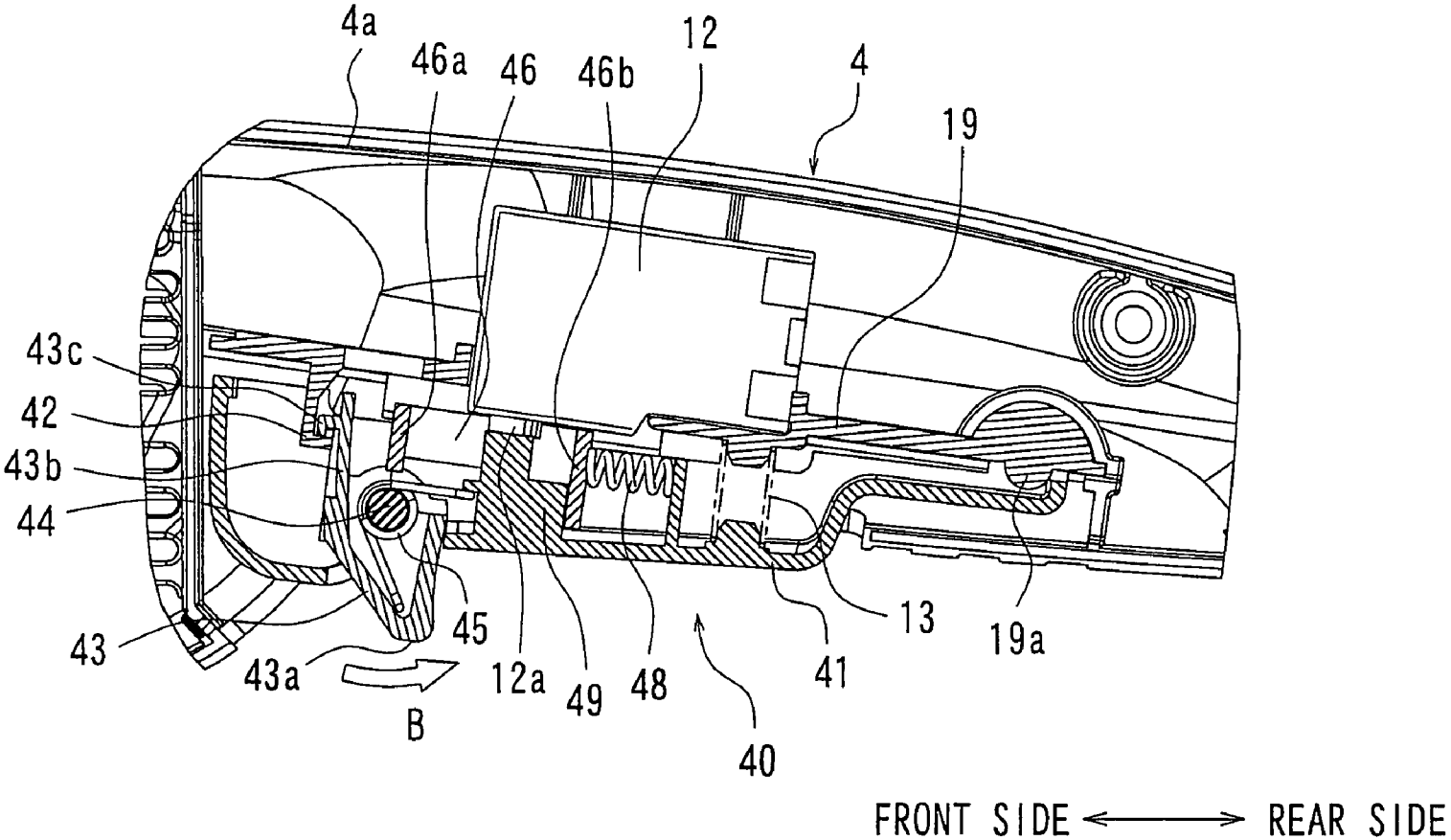
FIG. 15 is still further vertical sectional view of the handle including the switch device of the fourth embodiment, and showing an on-lock state of the switch device.

As shown in FIG. 13, in the state that the switch lever 41 has been tilted to the ON position, if the lock operation member 43 is operated to tilt toward the on-lock switching side indicated by arrow B in FIG. 15 against the action of the torsion spring 45, an L-shaped engagement portion 43*c* is engaged with an L-shaped engagement portion 42. The engagement portion 43*c* is provided at the tip end of the on-lock arm 43*b*, and the engagement portion 42 is provided integrally with the switch base 19. With this engagement, the lock operation member 43 is held in the on-lock position, and the switch lever 41 is locked in the ON position. With the switch lever 41 locked in the ON position, the switch body 12 is locked in the ON state so that the electric motor 5 is locked in the state of activation.

When the switch lever 41 is operated to tilt further, the engagement portion 43*c* of the on-lock arm 43*b* is disengaged from the engagement portion 42 so that the lock operation member 43 returns to the position shown in FIG. 14 by the biasing force of the torsion spring 45. With this disengagement between the engagement portion 43*c* and the engagement portion 42, the switch lever 41 is released from the on-lock state. Accordingly, when the tilting operation of the switch lever 41 is released, the switch lever 41 returns to the OFF position by the action of the compression spring 13.

Also with the switch device 40 of the fourth embodiment configured as described above, the operation direction of the lock operation member 43 for releasing the switch lever 41 from the off-lock state (the direction of arrow A) is opposite to the operation direction for changing the state of the switch lever 41 into the on-lock state (the direction of arrow B). This difference in direction allows the user to clearly distinguish between the off-lock release operation and the on-lock switching operation in terms of the operation direction of the lock operation member 43. Therefore, the user is inhibited from performing the on-lock switching operation continuously after the off-lock release operation, and in this respect, the switch device 40 can reliably reflect the user's intention in terms of operation.

Fifth Embodiment

Figure 16:
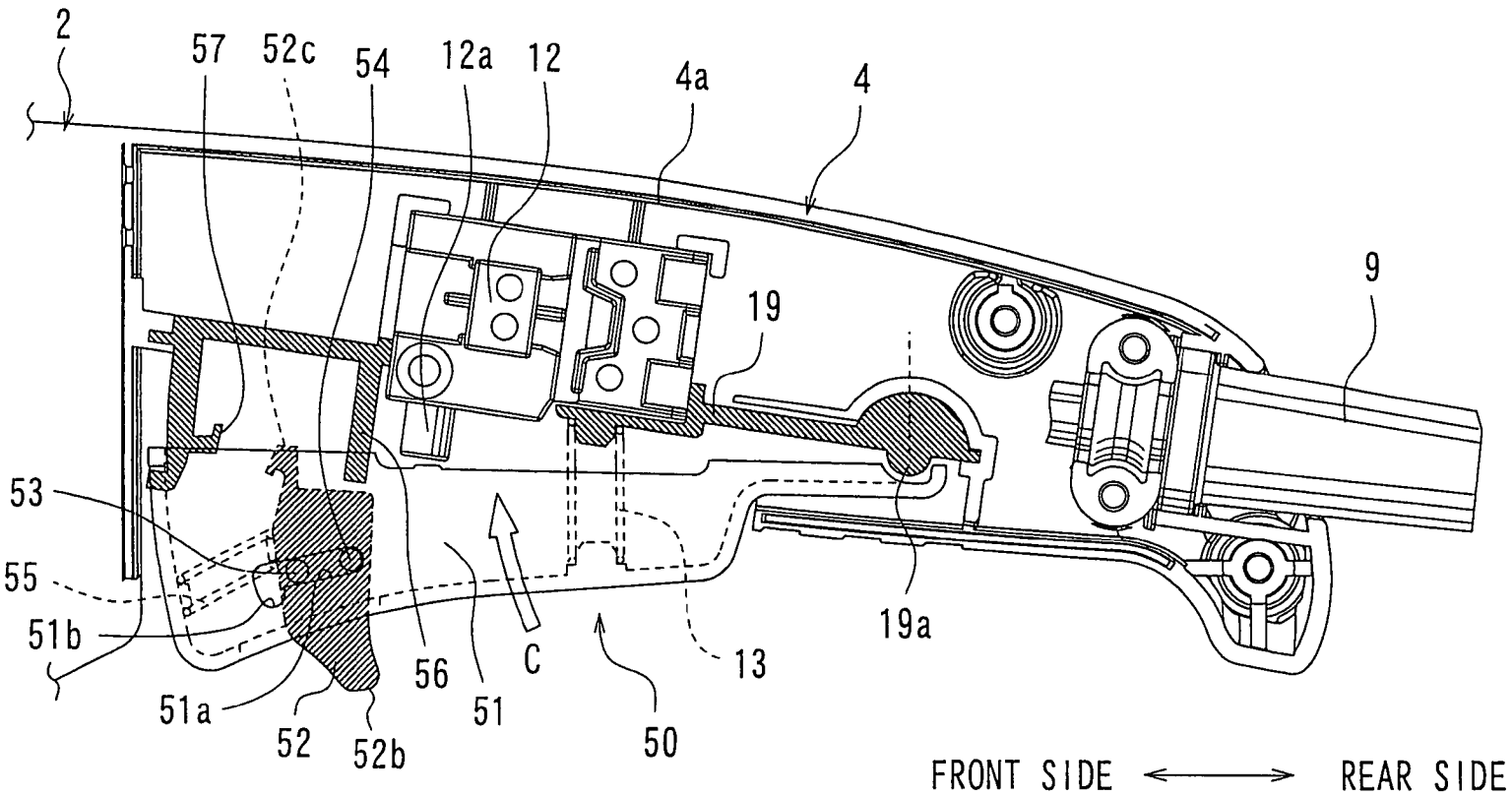
FIG. 16 is a vertical sectional view of a handle including a switch device according to a fifth embodiment of the present invention, and showing an off-lock state of the switch device.
Figure 17:
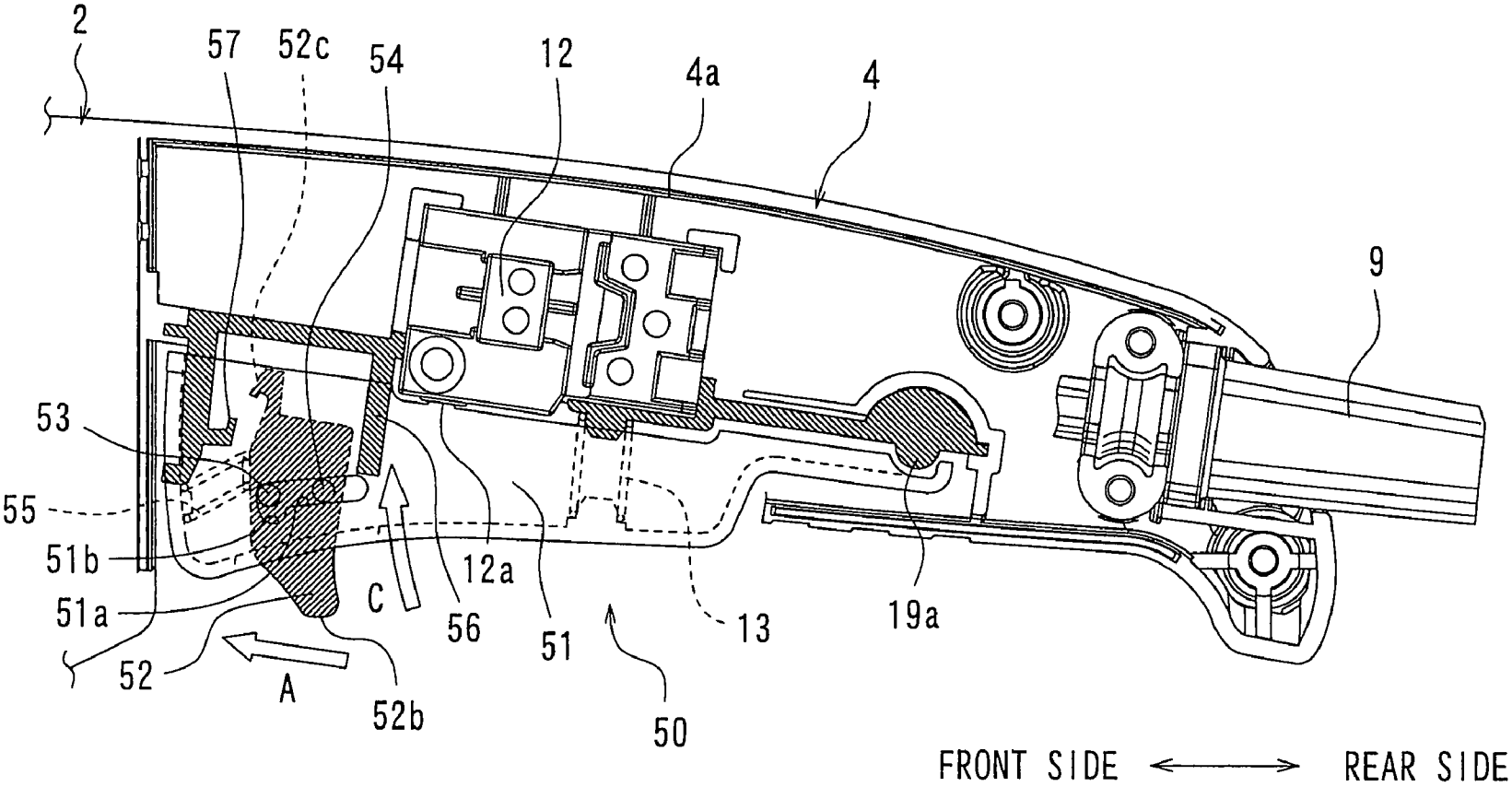
FIG. 17 is another vertical sectional view of the handle including the switch device of the fifth embodiment, and showing the state where a switch lever is operated to tilt toward an ON position.
Figure 18:
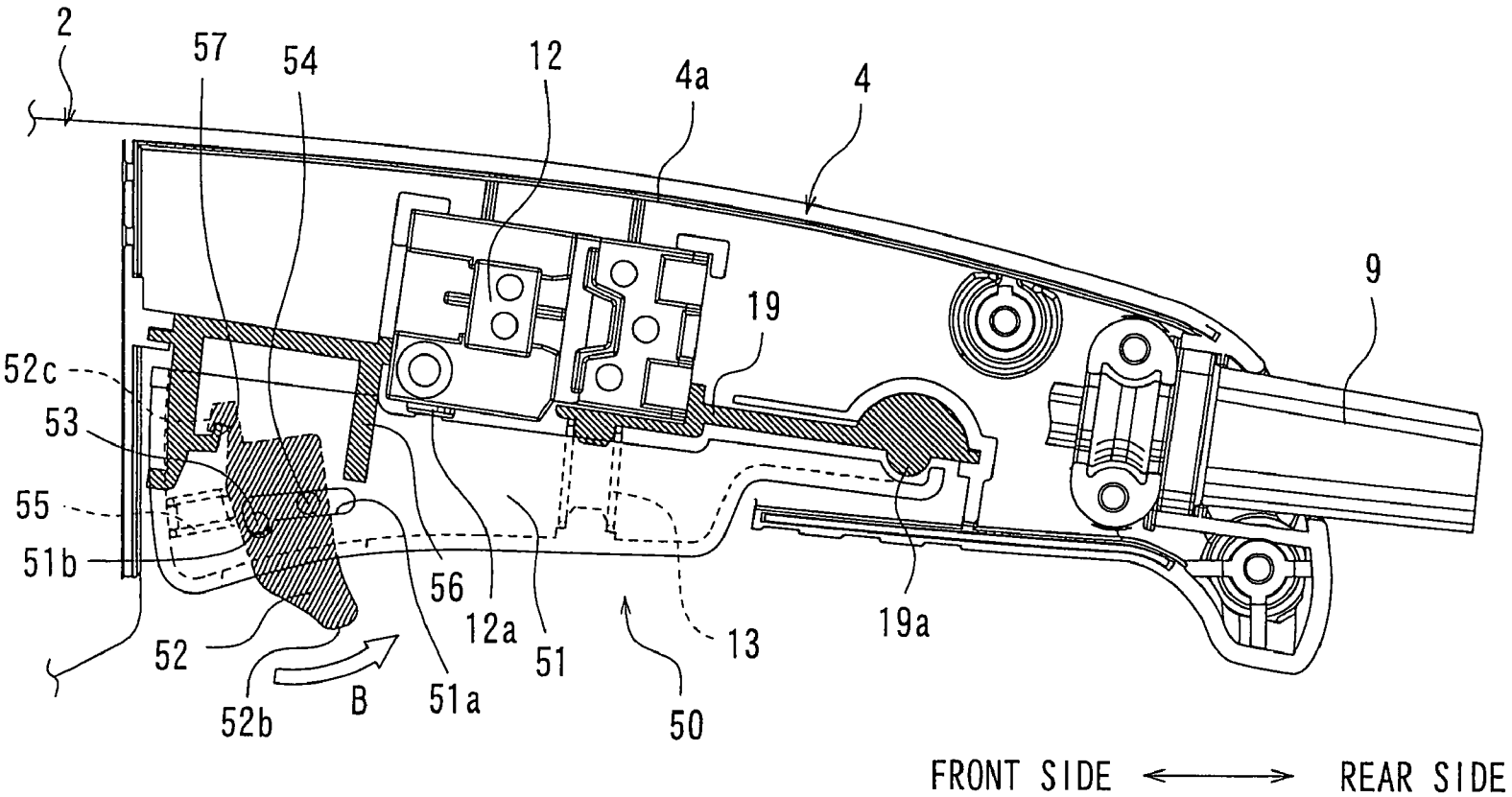
FIG. 18 is a further vertical sectional view of the handle including the switch device of the fifth embodiment, and showing an on-lock state of the switch device.
Figure 19:
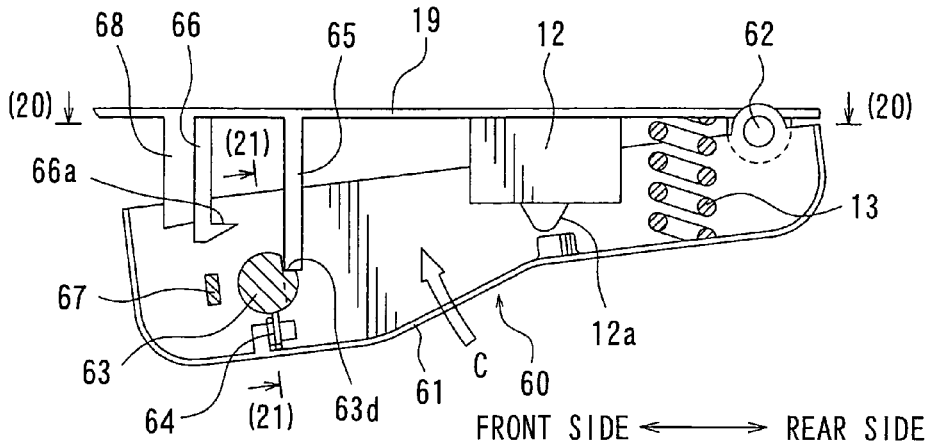
FIG. 19 is a vertical sectional view of a switch device according to a sixth embodiment of the present invention, and showing an off-lock state of the switch device.

Next, FIGS. 16 to 18 show a switch device 50 according to a fifth embodiment of the present invention. A switch lever 51 of the switch device 50 is so supported as to be able to tilt in the vertical direction via the support protrusion portion 19*a*, which is provided at the rear portion of the switch base 19. The switch base 19 is fixed to the handle case 4*a*. The switch body 12 is held between the switch base 19 and the handle case 4*a*, and is positioned substantially at the center of the handle case 4*a*.

At the front portion of the switch lever 51, a lock operation member 52 is supported. The lock operation member 52 of the fifth embodiment is supported by the switch lever 51 via two shafts 53 and 54 that are positioned on the front side and the rear side, respectively. Opposite end portions of each of the shafts 53 and 54 respectively protrude from the right and left side portions of the lock operation member 52. The protruded end portions of each of the shafts 53 and 54 are respectively inserted into right and left guide grooves 51*a*, which are disposed at the right and left side portions of the switch lever 51, respectively. By the right and left guide grooves 51*a*, the lock operation member 52 is so supported as to be able to slide within a fixed range in the forward and rearward directions. Front portions 51*b* of the right and left guide grooves 51*a* are each bent downward into an L shape.

Between the lock operation member 52 and the front portion of the switch lever 51, a compression spring 55 is disposed. By the action of this compression spring 55, the lock operation member 52 is biased in the direction of displacing toward the rear side, i.e., toward the off-lock position. As shown in FIG. 16, in the state that the lock operation member 52 is positioned in the off-lock position, the front and rear shafts 53 and 54 are respectively located in the guide grooves 51*a*. When the lock operation member 52 is moved to slide toward the front side against the action of the compression spring 55, the opposite end portions of the front shaft 53 are allowed to enter the front portions 51*b* of the guide groove portions 51*a*, respectively. In this state, the lock operation member 52 can be tilted in the counterclockwise direction in FIG. 16 via the rear shaft 54, i.e., in the on-lock switching direction.

In the state that the lock operation member 52 is positioned in the off-lock position by the action of the compression spring 55, an engagement protrusion portion 56 comes above the lock operation member 52. The engagement protrusion portion 56 is formed to be integral with the switch base 19 and protrudes downward therefrom. Because of abutment of the engagement protrusion portion 56 to the upper portion of the lock operation member 52, the switch lever 51 is held in the off-lock state, where the switch lever 51 is not allowed to be tilted toward the side of the ON position.

For releasing the switch lever 51 from the off-lock state, the lock operation member 52 must be slid in the off-lock release direction indicated by arrow A in FIG. 17 (toward the front side) by grasping the tip end portion 52*b* of the lock operation member 52. This accordingly causes the movement of the engagement protrusion portion 56 from the above of the lock operation member 52 toward the rear side so that the switch lever 51 can be tilted toward the ON position. FIG. 17 shows the state in which the switch lever 51 has been tilted to the ON position. As the switch lever 51 is operated to tilt toward the ON position, the switch body 12 is turned ON, and the electric motor 5 is activated.

If the user releases the operation of tilting the switch lever 51 toward the ON position, the switch lever 51 returns to the OFF position shown in FIG. 16 by the biasing force of the compression spring 13.

At the upper portion of the lock operation member 52, an L-shaped engagement portion 52*c* is provided. As shown in FIG. 17, in the state that the switch lever 51 is positioned in the ON position, if the lock operation member 52 is operated to tilt in the on-lock switching direction indicated by arrow B in FIG. 18, the engagement portion 52*c* is engaged with an engagement protrusion 57 provided integrally with the switch base 19 so that the switch lever 51 is locked in the ON position. With the switch lever 51 locked in the ON position, the switch body 12 is held in the ON state, and the electric motor 51 is locked in the state of activation.

The lock operation member 52 is operated to tilt toward the side of the on-lock position, i.e., the direction of arrow B, about the rear shaft 54 by moving the end portions of the front shaft 53 into the front groove portions 51*b*. The state of engagement between the engagement portion 52*c* and the engagement protrusion 57 is kept by the indirect action of the compression spring 55.

If the switch lever 51 is gripped more firmly, the engagement portion 52*c* is disengaged from the engagement protrusion 57 so that the switch lever 51 is released from the on-lock state. As the switch lever 51 is released from the on-lock state in this way, the lock operation member 52 returns to the side opposite to the direction of arrow B by the biasing force of the compression spring 55, and at the same time the lock operation member 52 is displaced toward the rear side and comes in contact with the engagement protrusion portion 56. Therefore, the switch lever 51 is allowed to return to the OFF position.

As the switch lever 51 returns to the OFF position, the lock operation member 52 is displaced by the biasing force of the compression spring 55 from the front side of the engagement protrusion portion 56 to the lower side thereof, so that the lock operation member 52 returns to the off-lock position shown FIG. 16.

Also with the switch device 50 of the fifth embodiment configured as described above, the operation direction of the lock operation member 52 for releasing the switch lever 51 from the off-lock state (the direction of arrow A) is opposite to the operation direction for changing the state of the switch lever 51 into the on-lock state (the direction of arrow B). This difference in direction allows the user to clearly distinguish between the off-lock release operation (the direction of arrow A) and the on-lock switching operation (the direction of arrow B) in terms of the operation direction of the lock operation member 52. Therefore, the user is prevented from performing the on-lock switching operation continuously after the off-lock release operation, and in this respect, the switch device 50 reliably reflects the user's intention in terms of operation.

Sixth Embodiment

Next, FIGS. 19 to 26 show a switch device 60 according to a sixth embodiment of the present invention. This switch device 60 of the sixth embodiment is configured to include the switch base 19, a switch lever 61, and the switch body 12, which are mounted within the handle case 4*a*. Similar to the embodiments described above, the switch body 12 is held between the switch base 19 and the handle case 4*a*, and is positioned substantially at the center of the handle case 4*a*.

The switch lever 61 is supported at the rear portion of the switch base 19 via a shaft 62 so that the switch lever 61 can tilt in the vertical direction. Between the switch lever 61 and the switch base 19, the compression spring 13 is disposed. By the action of the compression spring 13, the switch lever 61 is biased toward the OFF position on the lower side.

Figure 20:
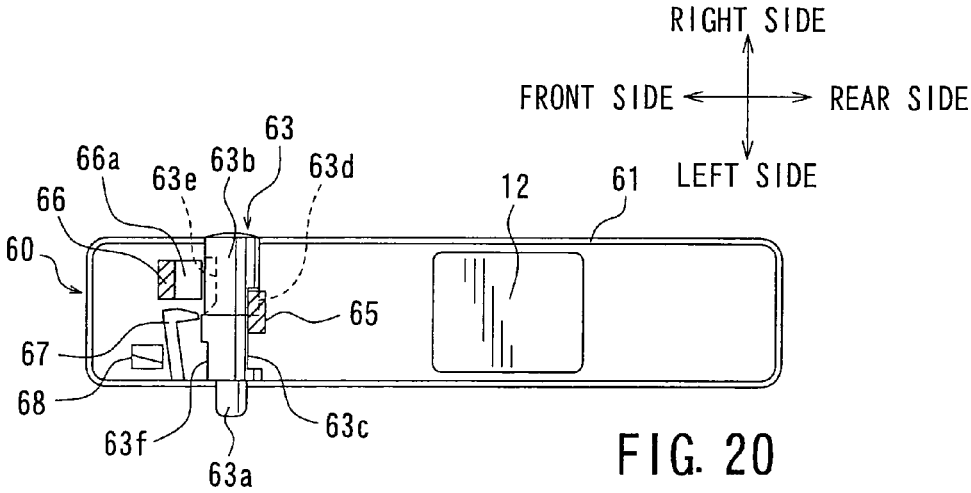
FIG. 20 is a sectional view of the switch device taken along line 20-20 in FIG. 19, and showing a switch lever in a plan view.
Figure 21:
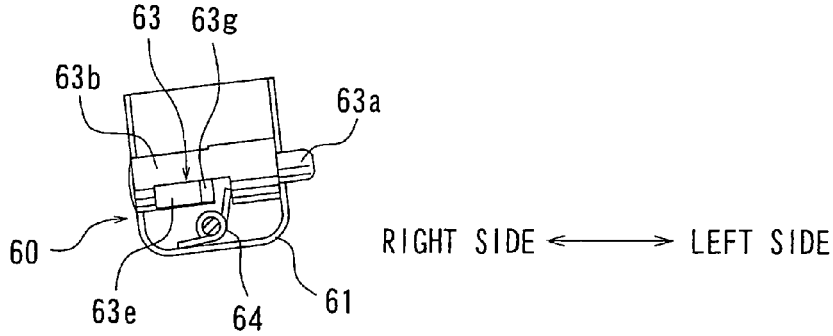
FIG. 21 is sectional view of the switch device taken along line 21-21 in FIG. 19, and showing a lock operation member as viewed from the front side.
Figure 22:
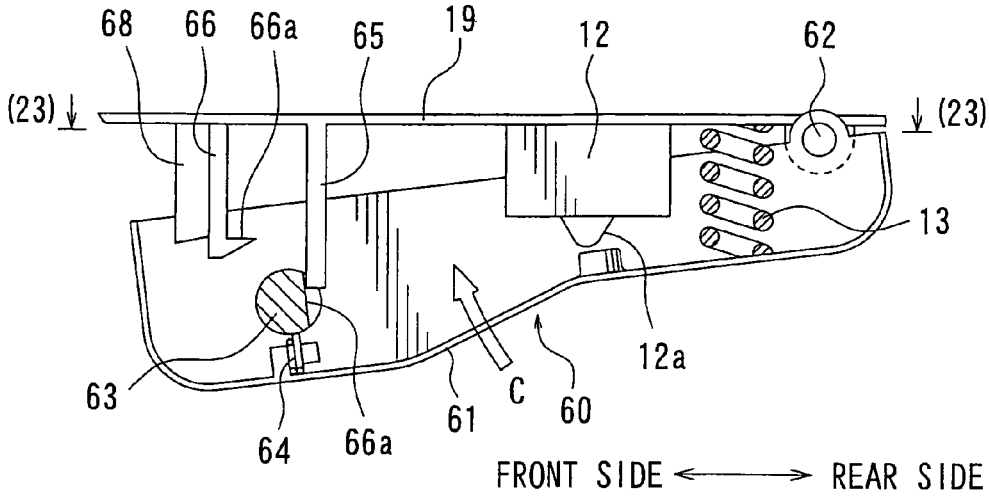
FIG. 22 is another vertical sectional view of the switch device of the sixth embodiment, and showing the state where the switch device is released from the off-lock state and the switch lever is positioned in the OFF position.

At the front portion of the switch lever 61, a lock operation member 63 is supported such that it can move in the width direction of the switch lever 61. This lock operation member 63 has a stepped configuration with a small-diameter portion 63*a* and a large-diameter portion 63*b*. The small-diameter portion 63*a* protrudes from the left side portion of the switch lever 61. The large-diameter portion 63*b* protrudes from the right side portion of the switch lever 61. As shown in FIG. 21, the lock operation member 63 is biased in the protruding direction of the small-diameter portion 63*a*, i.e., downward in FIG. 20, and rightward in FIG. 21, by the action of a torsion spring 64, which is disposed between the lock operation member 63 and the switch lever 61.

The large-diameter portion 63*b* of the lock operation member 63 is provided with a relief portion 63*c* and an engagement portion 63*d*. The relief portion 63*c* is formed by removing a rear part of the large-diameter portion 63*b* throughout the vertical length. The relief portion 63*c* is formed within a fixed range in the axial direction, i.e., in the vertical direction in FIG. 20. On the right end portion of the relief portion 63*c*, an engagement portion 63*d* is provided. This engagement portion 63*d* is formed by removing a rear upper part of the large-diameter portion 63*b*.

In connection with the relief portion 63*c* and the engagement portion 63*d*, the switch base 19 is provided with an engagement arm 65. This engagement arm 65 extends downward from the lower surface of the switch base 19. When the relief portion 63*c* is positioned on the lower side of this engagement arm 65, the switch lever 61 is allowed to be tilted toward the side of the ON position. On the other hand, when the engagement portion 63*d* is positioned on the lower side of the engagement arm 65, the engagement arm 65 may abut to the engagement portion 63*d* so that the switch lever 61 is restricted from being tilted toward the side of the ON position, i.e., in the direction of arrow C in FIG. 19. As shown in FIG. 20, when the small-diameter portion 63*a* protrudes from the left side portion of the switch lever 61, the engagement portion 63*d* is positioned on the lower side of the engagement arm 65 so that the switch lever 61 is restricted from being tilted toward the side of the ON position. Accordingly, as shown in FIG. 20, when the small-diameter portion 63*a* of the lock operation member 63 protrudes from the left side portion of the switch lever 61, the lock operation member 63 is in the off-lock state. Thus, the lock operation member 63 is biased toward the side of the off-lock position by the action of the torsion spring 64 described above, so that the off-lock mechanism is realized.

Figure 23:
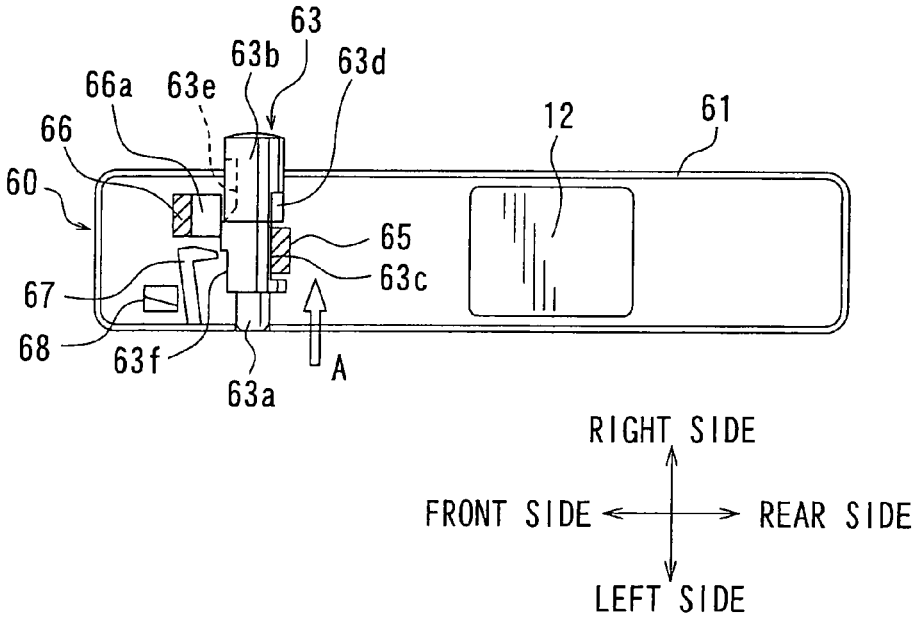
FIG. 23 is a sectional view of the switch device taken along line 23-23 in FIG. 22, and showing the switch lever in a plan view.

On the other hand, as shown in FIG. 23, when the small-diameter portion 63*a* of the lock operation member 63 is pushed toward the right side against the action of the torsion spring 64, i.e., in the direction of arrow A in FIG. 23, the large-diameter portion 63*b* protrudes from the right side portion of the switch lever 61. As a result, the relief portion 63*c* comes to the lower side of the engagement arm 65. In this state, the engagement arm 65 is allowed to pass downward through the relief portion 63*c* so that the switch lever 61 is brought into the off-lock release state. Thus, the switch lever 61 is allowed to be tilted toward the side of the ON position. In this off-lock release state, as shown in FIG. 24, operating the switch lever 61 to tilt or to be pulled toward the side of the ON position, i.e., in the direction of arrow C by the fingertip of the user causes the operating knob 12*a* to be pushed, so that the switch body 12 is turned ON, thereby activating the electric motor 5.

A stopper arm 67 is disposed at the inner surface of the switch lever 61 in the vicinity of the small-diameter portion 63*a* of the lock operation member 63. This stopper arm 67 extends in the width direction, i.e., in the vertical direction in FIGS. 20, 23, 25, and 27, of the switch lever 61 from the left inner surface of the switch lever 61 toward the right inner surface thereof. The stopper arm 67 is integrally provided with, at the tip end thereof, a stopper claw portion 67*a*. The stopper claw portion 67*a* is so provided as to extend toward the side of the lock operation member 63, i.e., toward the rear side.

On the front side of this stopper arm 67, a restriction arm 68 is disposed. This restriction arm 68 extends downward from the lower surface of the switch base 19 and is formed integrally therewith. Therefore, the stopper arm 67 extends in the horizontal direction to intersect like a cross with the restriction arm 68 extending in the vertical direction. At a portion opposing to the stopper claw portion 67*a* of the stopper arm 67, i.e., at the side portion of the large-diameter portion 63*b* of the lock operation member 63, a flat stopper surface 63*f* is formed. Moreover, as will be described later, if the switch lever 61 is pulled toward the ON position, the stopper arm 67 is displaced upward, and is brought into slide contact with the rear surface of the restriction arm 68. In this state, the stopper arm 67 is pushed toward the rear side by the resilient force of the restriction arm 68.

Figure 24:
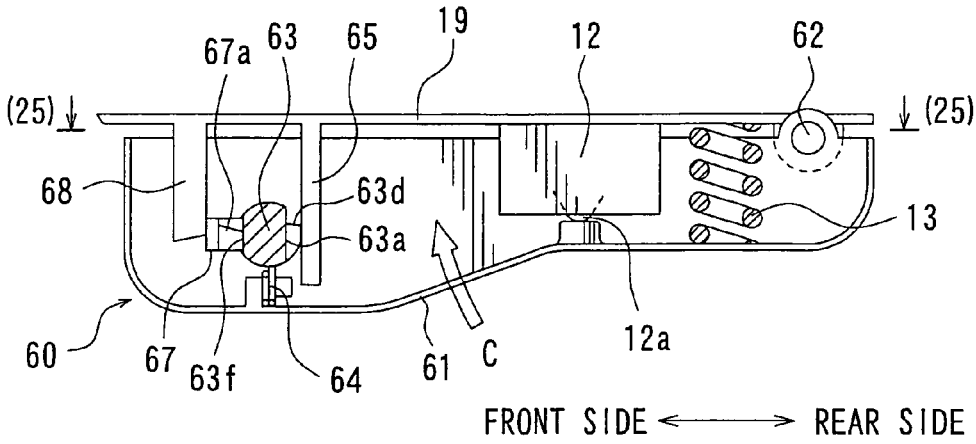
FIG. 24 is a further vertical sectional view of the switch device of the sixth embodiment, and showing the state where the switch device is released from the off-lock state and the switch lever is operated to tilt toward an ON position.
Figure 25:
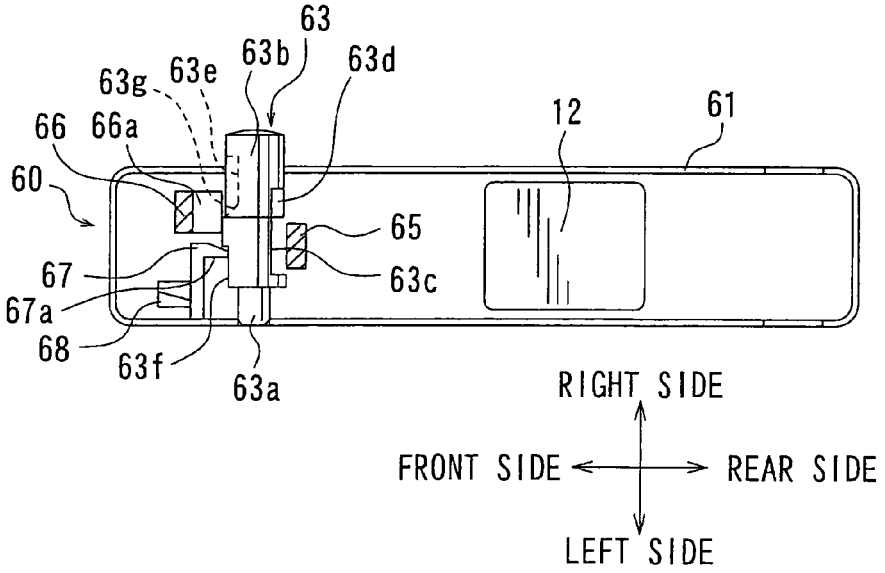
FIG. 25 is a sectional view of the switch device taken along line 25-25 in FIG. 24 and showing the switch lever in a plan view.

Therefore, releasing the switch lever 61 from the off-lock state by pushing the small-diameter portion 63*a* of the lock operation member 63, and thereafter, in this off-lock release state, by operating the switch lever 61 to tilt toward the ON position, as shown in FIGS. 24 and 25, the stopper claw portion 67*a* of the stopper arm 67 is resiliently pressed against the stopper surface 63*f* of the large-diameter portion 63*b*. With the stopper claw portion 67*a* being pressed against the stopper surface 63*f*, the lock operation member 63 is held in the off-lock release position against the action of the torsion spring 64. In this way, after the switch lever 61 has been operated to tilt to the ON position by pushing the lock operation member 63 toward the off-lock release position in the direction of arrow A, this lock operation member 63 is held in the off-lock release position, i.e., the position shown in FIG. 25, by the stopper claw portion 67*a*. The user thus can remove his or her fingertip from the small-diameter portion 63*a* of the lock operation member 63.

If the pulling operation of the switch lever 61 is released, the switch lever 61 returns to the OFF position on the lower side by the action of the compression spring 13, and the switch body 12 is thus turned OFF, so that the electric motor 5 is stopped. Moreover, if the switch lever 61 returns to the OFF position on the lower side, the stopper arm 67 moves downward away from the restriction arm 68, and thus no pressing force is applied. As a result, due to the resilient force of the stopper arm 67, the stopper claw portion 67*a* moves forwardly. Because the stopper claw portion 67*a* is released from the pressing condition against the stopper surface 63*f*, due to the biasing force of the torsion spring 64, the lock operation member 63 returns to the off-lock position where the side of the small-diameter portion 63*a* protrudes from the left side portion of the switch lever 61. Accordingly, the switch lever 61 returns to the off-lock state, where the tilting operation toward the side of the ON position is restricted.

Figure 26:
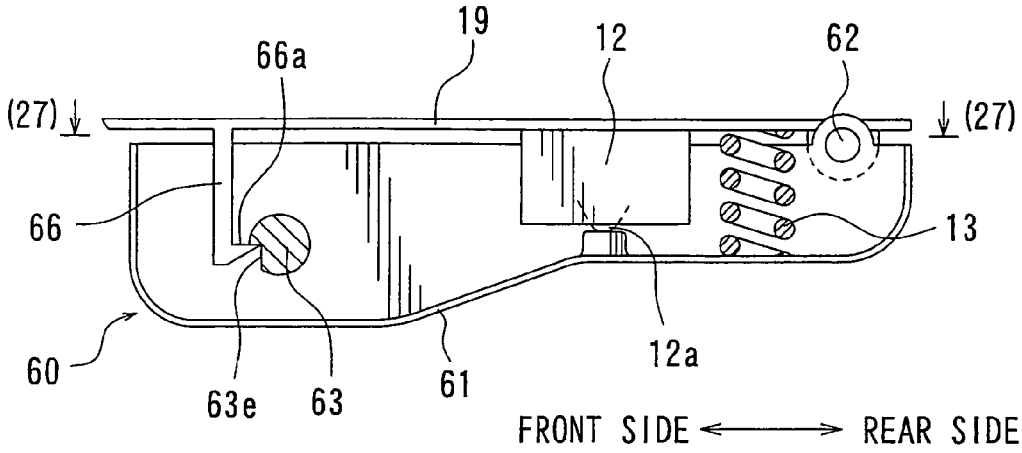
FIG. 26 is a further vertical sectional view of the switch device of the sixth embodiment, and showing an on-lock state of the switch device.
Figure 27:
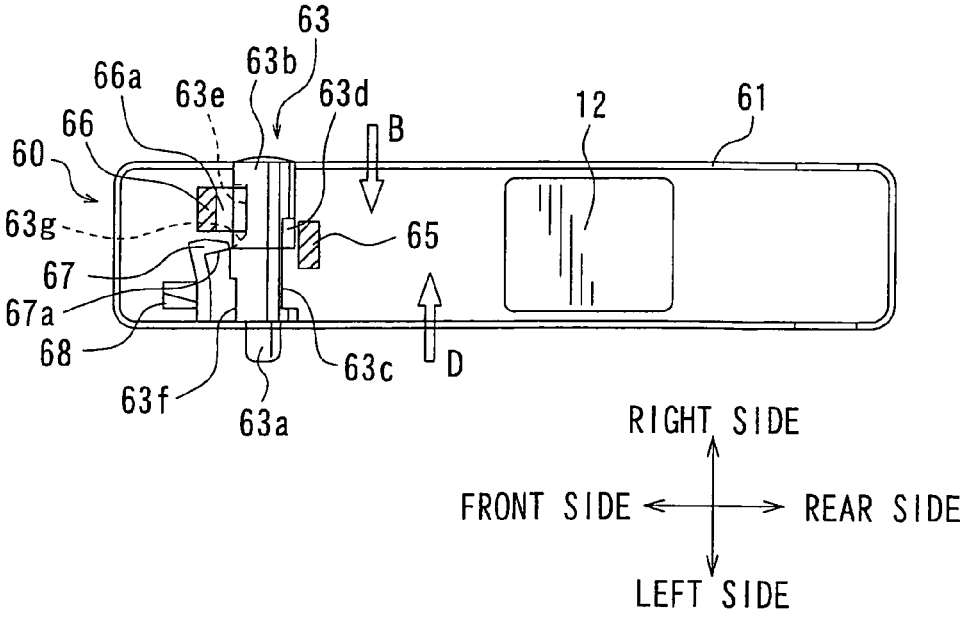
FIG. 27 is a sectional view of the switch device taken along line 27-27 in FIG. 26, and showing the switch lever in a plan view.

Next, as shown in FIGS. 25 and 26, in the state that the switch lever 61 has been tilted to the ON position, if the large-diameter portion 63*b* of the lock operation member 63 is pushed in the direction of arrow B in FIG. 27, the switch lever 61 is locked in the ON position, i.e., the on-lock state. In this on-lock state, pushing the lock operation member 63 in the reverse direction, i.e., in the direction of arrow D causes the switch lever 61 to be released from the on-lock state.

At the front portion of the switch base 19, an on-lock arm 66 is provided. This on-lock arm 66 extends downward to rear a position on the front side of the lock operation member 63. At the lower end portion of this on-lock arm 66, an engagement claw portion 66*a* is provided. This engagement claw portion 66*a* is so provided as to extend toward the side of the lock operation member 63, i.e., toward the rear side. On the other hand, the large-diameter portion 63*b* of the lock operation member 63 is provided with a lock concave portion 63*e*. As shown in FIG. 26, this lock concave portion 63*e* is of the size allowing insertion of the engagement lug portion 66*a* of the on-lock arm 66 in order to restrict any downward displacement of the lock operation member 63 and eventually the switch lever 61. On the left end portion of the lock concave portion 63*e*, an inclined guide surface 63*g* is provided for the movement of the engagement claw portion 66*a* in the removal direction by the movement of the lock operation member 63.

As shown in FIGS. 24 and 25, in the state that the lock operation member 63 is positioned in the off-lock release position and the switch lever 61 is positioned in the ON position, the engagement claw portion 66*a* of the on-lock arm 66 is pressed against the peripheral surface of the large-diameter portion 63*b* of the lock operation member 63. The engagement claw portion 66*a* is resiliently pressed against the peripheral surface of the large-diameter portion 63*b* by the resilient force of the on-lock arm 66. In this stage, the engagement claw portion 66*a* is not yet entered in the lock concave portion 63*e*.

Next, as shown in FIG. 27, if the large-diameter portion 63*b* of the lock operation member 63 is pushed in the direction of arrow B, the lock concave portion 63*e* moves to be positioned directly behind the engagement lug portion 66*a* of the on-lock arm 66. Then, the engagement claw portion 66*a* is fitted into the lock concave portion 63*e* by the resilient force of the on-lock arm 66. When the engagement claw portion 66*a* of the on-lock arm 66 is fitted into the lock concave portion 63*e* of the large-diameter portion 63*b*, as shown in FIG. 26, the large-diameter portion 63*b* of the lock operation member 63 is brought to be supported by the engagement claw portion 66*a* from the below. As a result, the switch lever 61 is restricted from being moved toward the side of the OFF position, thereby being brought into the on-lock state.

In this on-lock state, if the small-diameter portion 63*a* of the lock operation member 63 is pushed again in the direction of arrow D against the action of the torsion spring 64, the switch lever 61 can be released from the on-lock state. When the lock operation member 63 is displaced upward in FIG. 27, the engagement claw portion 66*a* of the on-lock arm 66 slides on the inclined guide surface 63 so that the engagement claw portion 66*a* moves away from the lock concave portion 63*e*. When the small-diameter portion 63*a* has been pushed up to a position where it does not protrude from the left side portion of the switch lever 61, the on-lock arm 66 is bent or flexed toward the front side against the resilient force thereof, and the engagement claw portion 66*a* is removed completely from the lock concave portion 63*e*, thereby being again elastically pressed against the peripheral surface of the large-diameter portion 63*b* as shown in FIG. 25. In this state, the lock operation member 63 and eventually the switch lever 61 are allowed to be displaced downward so that the switch lever 61 is released from the on-lock state.

As described above, also with the switch device 60 of the sixth embodiment, pushing the lock operation member 63 in the off-lock release direction indicated by arrow A can release the switch lever 61 from the off-lock state. Moreover, in the state that the switch lever 61 has been tilted to the ON position, if the lock operation member 63 is pushed in the on-lock direction indicated by arrow B, the switch lever 61 can be changed in state to the on-lock state. Therefore, the operation direction of the lock operation member 63 for releasing the switch lever 61 from the off-lock state (the direction of arrow A) is opposite to the operation direction thereof for changing the state of the switch lever 61 to the on-lock state (the direction of arrow B).

This difference in direction can prevent an accidental operation, in which moving the lock operation member 63 in the off-lock release direction indicated by arrow A causes the switch lever 61 to be brought into the on-lock state when the lock operation member 63 is continuously moved in the same direction. According to the above embodiment, for changing the switch lever 61 to the on-lock state, the lock operation member 63 is required to be moved in the opposite direction indicated by arrow B, and in this respect, the switch device 60 can reliably reflect the user's intention in terms of operation.

The above first to sixth embodiments have been described with regard to the configuration in which, for a single piece of the lock operation member, the operation directions for releasing the switch lever from the off-lock state and the operation direction for changing the state to the on-lock state are opposite to each other. Alternatively, two separate lock operation members may be provided respectively for these operations and the same effects as above can be achieved by this arrangement. For example, the switch lever may be used as a lock operation member for releasing the switch lever from the off-lock state, and another operation member separately provided from the switch lever may be used as a lock operation member for changing the state of the switch lever into the on-lock state. This alternative embodiment will be described as follows as a seventh embodiment.

Seventh Embodiment

A seventh embodiment according to the present invention will now be described with reference to FIGS. 28 to 31, which show a switch device 70 according to the seventh embodiment.

In this embodiment, a window portion 79*a* is formed substantially centrally of a switch base 89 that corresponds to the switch base 19 of the above embodiments. The operation knob 12*a* of the switch body 12 extends downward through the window portion 79*a* toward a switch lever 71 that corresponds to the switch lever 11.

The switch lever 71 is supported to extend in forward and rearward directions along the lower side of a switch base 79 that corresponds to the switch base 19. More specifically, the rear portion of the switch lever 71 is coupled to the rear portion of the switch base 79 via a shaft 74, so that the switch lever 71 can tilt vertically about an axis of the shaft 74. The shaft 74 is inserted into an elongated slot 71*b* formed in the rear portion of the switch lever 71 and extending in forward and rearward directions. Therefore, the switch lever 71 can slide in forward and rearward directions relative to the switch base 79 within a predetermined range in addition to the tilting movement about the shaft 74.

At the left and right sides of the front side portion of the switch lever 71, a pair of left and right restriction arms 71*c* are provided. The left and right restriction arms 71*c* extend upward in parallel with each other. Engaging claws 72*d* are provided at the upper end portions of the respective restriction arms 71*c*. On the other hand, at the front portion of the switch base 79, insertion slots 79*b* are formed to correspond to the restriction arms 71*c*. The insertion slots 79*b* extend in forward and rearward directions in parallel with each other. The restricting arms 72*c* are inserted into the respective insertion slots 79*b* to extend upwardly from below of the switch base 79 so as to be assembled therewith. The engaging claws 71*d* of the restriction arms 71*c* engage with an upper surface of the switch base 79, so that the restriction arms 71*c* are prevented from being removed from the insertion slots 79*b*.

Therefore, the switch lever 71 can tilt vertically relative to the switch base 79 within such a range that the restriction arms 71*c* can move vertically within the respective insertions slots 79*b*. In addition, the switch lever 71 can slide in forward and rearward directions relative to the switch base 79 within such a range that the restriction arms 71*c* can move in forward and rearward directions within the insertion slots 79*b*.

Two compression springs 73 and 78 are disposed between the switch lever 71 and the switch base 79. The compression spring 73 is disposed vertically between the switch lever 71 and the switch base 79 so that the switch lever 71 is biased in a direction of tilting toward an OFF position on the lower side (in an opposite direction to the direction indicated by arrow C. The compression spring 78 is disposed in forward and rearward directions (i.e., substantially horizontally) between the switch lever 71 and the switch base 79, so that the switch lever 71 is biased in a direction of sliding toward an off-lock position on the rear side (i.e., a direction opposite to the direction indicated by arrow A).

An on-lock mechanism and an off-lock mechanism are assembled with the switch lever 71. The on-lock mechanism serves to lock the switch lever 71 in an ON position and the off-lock mechanism serves to lock the switch lever 71 in the OFF position. These mechanisms are configured such that different operation members perform releasing the off-lock state and switching to the on-lock state. In this embodiment, release of the on-lock state is achieved by the sliding operation of the switch lever 71 and switching to the on-lock state is achieved by operating an on-lock operation member 75 that will be described later.

The on-lock operation member 75 is supported at a position on the front side of the switch lever 71. A tip end portion 75*b* of the on-lock operation member 75 extends downwardly through a window portion 71*a* provided at the lower surface of the switch lever 71. The on-lock operation member 75 is supported via a support shaft 75*a* such that the on-lock operation member 75 can tilt in forward and rearward directions. In addition, the on-lock operation member 75 is biased by a torsion spring 76 in a counterclockwise direction as viewed in FIG. 28, i.e., a direction of displacing the tip end portion 75*b* toward the rear side (the side of the on-lock releasing position).

An engaging arm 75*c* is integrally provided at the front portion of the on-lock operation member 75 and extend upward. An on-lock claw 75*d* is provided integrally at an upper portion of the engaging arm 75*c* and extends rearward.

To correspond to the engaging arm 75*c*, a lock arm 77 is integrally provided at the front portion of the switch base 79 and extends downwardly from the lower surface of the switch base 79. A lock claw 77*a* is integrally provided at the lower portion of the front surface of the lock arm 77.

Figure 28:
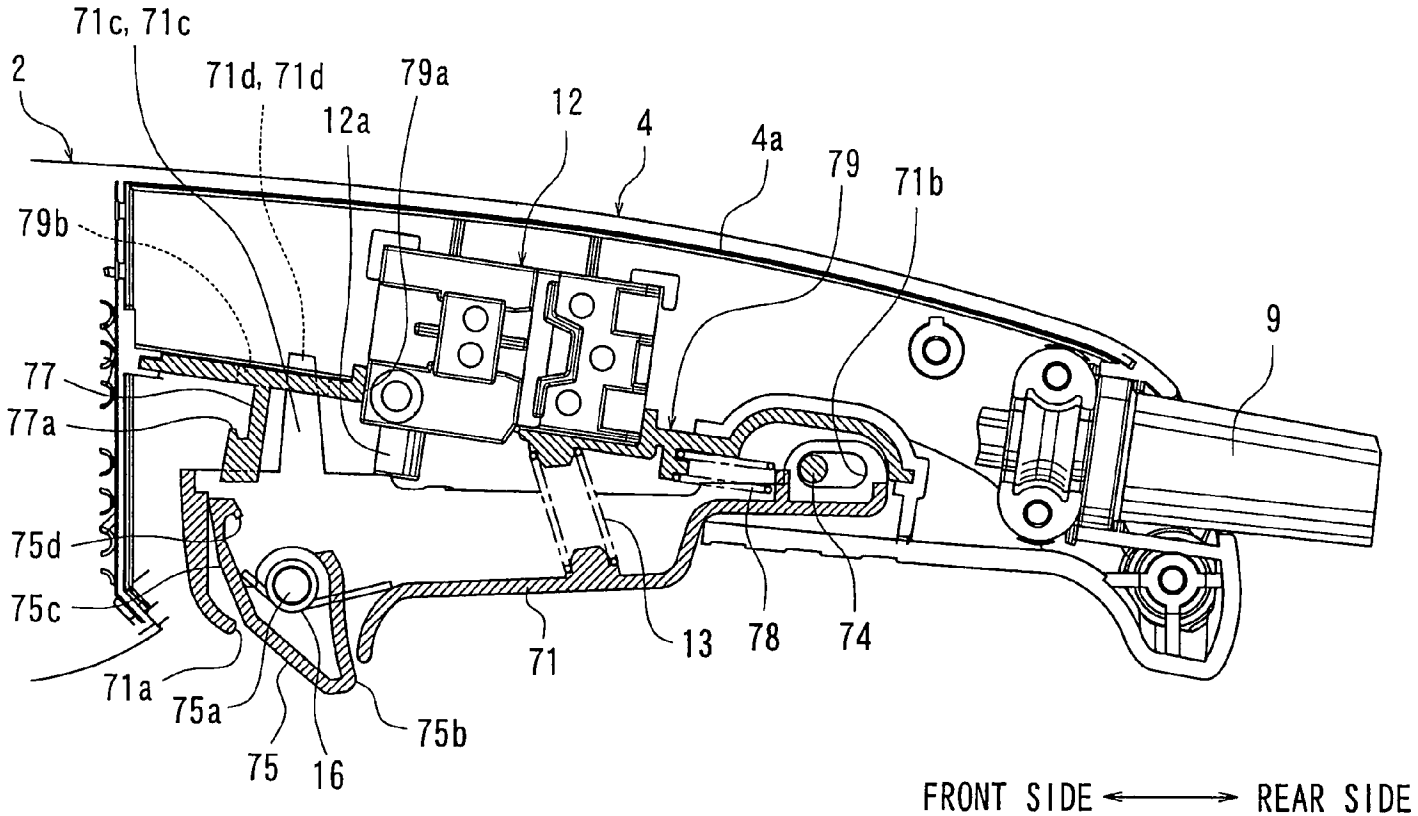
FIG. 28 is a vertical sectional view of a switch device according to a seventh embodiment of the present invention, and showing an off-lock state of the switch device.

With the switch device 70 of this embodiment, if the operator does not operate the switch lever 71, the switch lever 71 is held at the OFF position on the lower side by the biasing force of the compression spring 73 and at the off-lock position on the rear side by the biasing force of the compression spring 18 (see FIG. 28). In the state that the switch lever 71 is positioned at the OFF position, the on-lock operation member 15 is held at the on-lock releasing position, where the tip end portion 75*b* is displaced rearwardly, by the biasing force of the torsion spring 76.

In the initial state where the on-lock operation member 75 is held at the on-lock releasing position, the lock arm 75 is positioned directly above the engaging arm 75*c*. Therefore, in this state, the operation for tilting the switch lever 71 from the off-lock position on the rear side toward the side of the ON position (i.e., upward) is restricted because the upward movement of the engaging arm 75*c* is restricted by the lock arm 77. Thus, the switch lever 71 cannot be tilted toward the side of the ON position (in the direction indicated by arrow C in FIG.

29). As a result, the off-lock state is achieved, so that an accidental ON operation of the switch lever 71 can be prevented.

Figure 29:
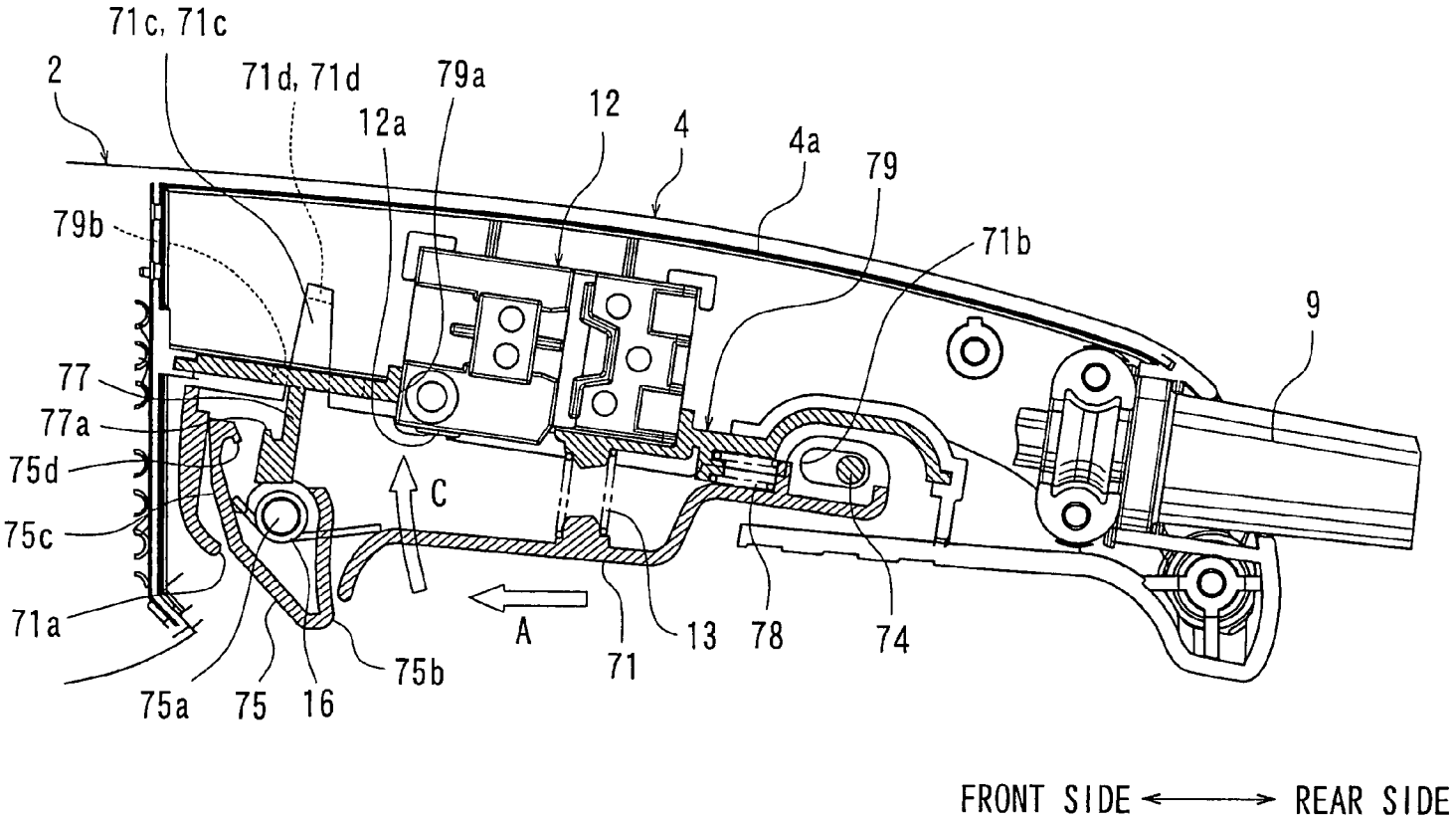
FIG. 29 is another vertical sectional view of the switch device of the seventh embodiment, and showing the state where the switch device is released from the off-lock state and the switch lever is positioned in an ON position.
Figure 30:
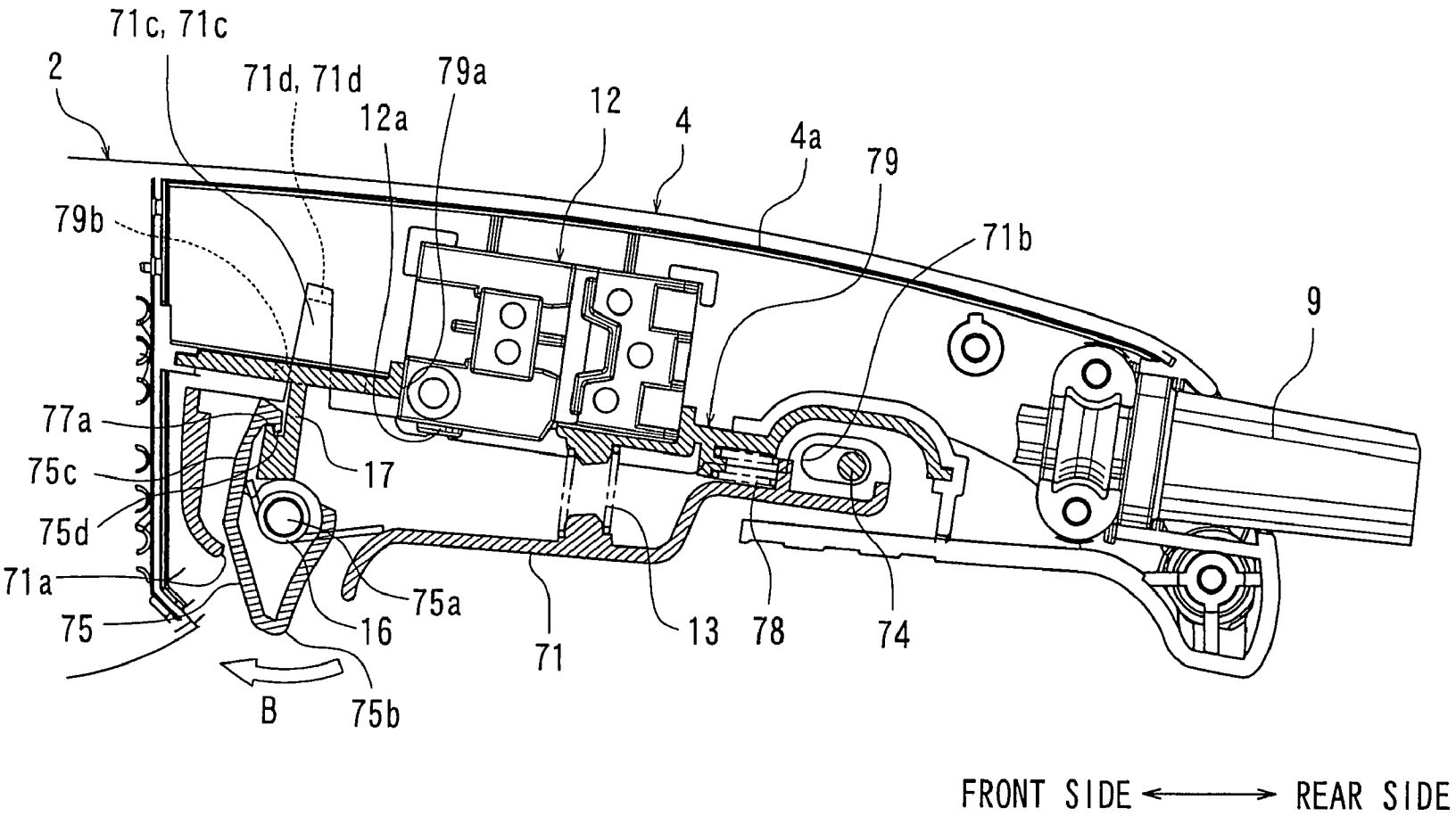
FIG. 30 is a further vertical sectional view of the switch device of the seventh embodiment, and showing an on-lock state of the switch device.
Figure 31:
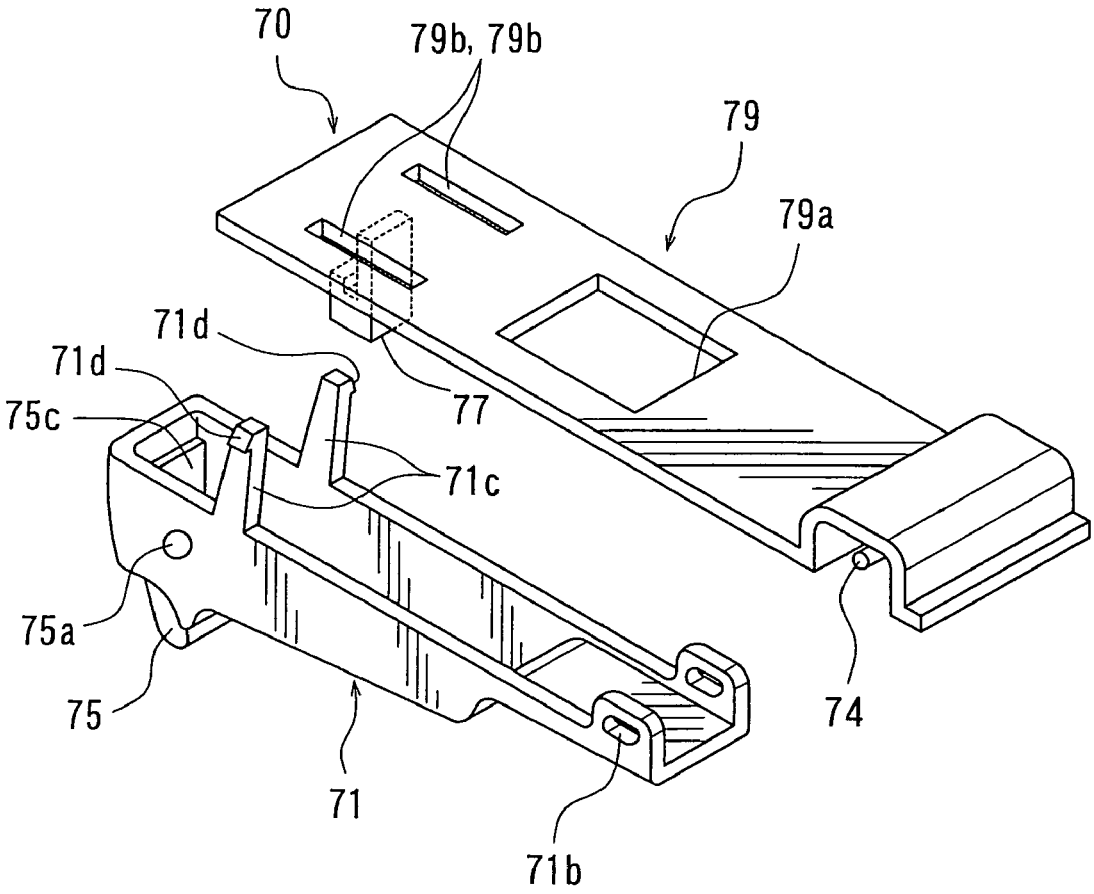
FIG. 31 is an exploded perspective view of the switch device, and showing only a switch base and a switch lever.

On the other hand, if the switch lever 71 is slide in the direction indicated by arrow A in FIG. 29 against the biasing force of the compression spring 78, the engaging arm 75*c* moves forwardly away from the lock arm 77 so that the switch lever 71 is allowed for tilting toward the side of the ON position (the direction indicated by arrow C). Thus, the off-lock release state is achieved. Tilting the switch lever 71 toward the ON position (the direction indicated by arrow C) by firmly gripping the switch lever 71 continuously after releasing the off-lock state causes the operation knob 12*a* to be pushed so that the switch body 12 is turned ON, thereby activating the electric motor 5.

If the user releases the tilting operation of the switch lever 71 toward the side of the ON position, which is performed using his or her fingertip, the switch lever 71 returns to the OFF position on the lower side. If the user also releases the sliding operation of the switch lever 71 toward the front side after the switch lever 71 has returned to the OFF position, the switch lever 71 returns to the off-lock position on the rear side by the biasing force of the compression spring 78. When the switch lever 71 returns to the off-lock position, the engaging arm 75*c* is positioned directly below the lock arm 77, so that the off-lock state is resulted. In the off-lock state, the pulling operation of the switch lever 71 toward the side of the ON position is inhibited.

In addition to the off-lock function described above, the switch device 70 of this embodiment can perform the on-lock function. In the state the switch lever 71 has been slid to the off-lock releasing position as indicated by arrow A in FIG. 29, if the switch lever 71 is tilted to the ON position as indicated by arrow C, the switch body 12 is turned ON for activating the electric motor 5. Thereafter, the on-lock operation member 75 may be tilted toward the on-lock position as indicated by arrow B, i.e., the direction of displacing the tip end portion 75*b* toward the front side.

As a result of the tilting movement toward the on-lock position of the on-lock operation member 75, the on-lock claw 75*d* of the engaging arm 75*c* moves to a position on the upper side of the lock claw 77*a* of the lock arm 77. When the user weakens the gripping force toward the side of the ON position of the switch lever 71 while maintaining the on-lock operation of the on-lock operation member 15, the on-lock claw 75*d* is brought to engage with the lock claw 77*a* of the lock arm 77, in such a manner that on-lock claw 75*d* is pressed against the lock claw 77*a* from above, by the biasing force of the compression spring 73 applied to the switch lever 71. Because the on-lock claw 75*d* of the engaging arm 75*c* engages with the lock claw 77*a* of the lock arm 77 from above, the on-lock operation member 75 is held in the on-lock position, and at the same time, the tilting movement of the switch lever 71 toward the OFF position can be restricted.

Because the switch lever 71 is restricted from movement toward the OFF position and is held in the ON position, the switch body 72 is held in the ON state. Therefore, the electric motor 5 is locked in the activated state. With the switch lever 71 locked in the ON position, the operator can lock the electric motor 5 in the activated state without need of pulling the switch lever 71. Therefore, it is possible to easily perform the operation of the power tool by gripping the handle 4.

In the on-lock state, if the use grips the switch lever 71 upward again, the lock-in claw 75*d* of the on-lock operation member 75 moves upward, so that the engaging state of on-lock claw 75*d* with the lock claw 77*a* of the lock arm 77 is released. Then, the on-lock operation member 75 returns in a such direction that the tip end portion 75*b* is displaced rearwardly (in the counterclockwise direction or the direction toward the on-lock releasing position). As shown in FIG. 29, when the on-lock operation member 75 returns to the on-lock releasing position, the switch lever 71 can be returned toward the OFF position on the lower side. After the switch body 72 has been returned to the OFF position by returning the switch lever 71 to the switch lever 71, if the forward sliding operation of the switch lever 71 is stopped, the switch lever 71 returns to the off-lock position on the rear side by the biasing force of the compression spring 78.

As shown in FIG. 28, when the switch lever 71 returns to the off-lock position on the rear side, the engaging arm 75*c* of the on-lock operation member 15 is again brought into a position directly below the lock arm 77. As a result, the switch device 70 returns to the off-lock state or the initial state.

As described above, according to the switch device 70 of this embodiment, slidably moving the switch lever 75 toward the off-lock releasing position indicated by arrow A in FIG. 29, the off-lock state of the switch lever 71 can be released. In addition, in the state that the switch lever 71 is held in the ON position, operating the on-lock operation member 75 to tilt in the on-lock direction indicated by arrow B in FIG. 30 can switch the switch lever 71 to the on-lock state. In this way, the switch lever 71 that is operated for releasing the off-lock mechanism is a separate member from the on-lock operation member 75 that is operated for making the on-lock mechanism effective. Therefore, the off-lock releasing operation and the on-lock switching operation can be performed while these operations are clearly distinguished by the user. Hence, unintentional switching to the on-lock state after the operation for releasing the on-lock state can be reliably prevented. As a result, the switch device 70 can reliably reflect the user's intention in terms of operation.

The above seventh embodiment may be modified further. For example, although the switch lever 71 is used as an operation member for releasing the off-lock state of the switch device 70, a separated member from the switch lever 71 can be used as the off-lock releasing member.

In addition, although the switch lever 71 is operated to slide for releasing the off-lock state, the off-lock state of the switch lever 71 can be released by a tilting movement, in particular, in the case that a separate member from the switch lever 71 is used for releasing the off-lock state as described above.

Further, in the case that a separate member from the switch lever 71 is used for releasing the off-lock state, it is possible to construct such that the switch lever 71 is slid forwardly or rearwardly for changing to the on-lock state.

Although a disk grinder is exemplified as an example of the electric power tool in the above embodiments, the switch device of the present invention may be widely applicable to any other electric power tools, such as an electric drill used for boring, an electric screwdriver used for driving screws, and a circular saw used for cutting.

This invention claims:

1. A switch device for a power tool, comprising:

a switch lever operable to move between an ON position for activating the power tool and an OFF position for stopping activation of the power tool;

an on-lock mechanism capable of locking the switch lever in the ON position;

an off-lock mechanism capable of locking the switch lever in the OFF position; and a single lock operation member operable in a first direction for making the on-lock mechanism effective and operable in a second direction for releasing the off-lock mechanism;

wherein:

the first direction and the second direction are different from each other, and the lock operation member is tiltably supported on the switch lever.

2. The switch device as in claim 1, wherein the first direction and the second direction are opposite to each other.

3. The switch device as in claim 1, wherein the lock operation member is a separate member from the switch lever.

4. The switch device as in claim 1, further comprising a switch base, on which the switch lever is supported, wherein the lock operation member is supported on the switch lever.

5. The switch device as in claim 4, wherein the switch lever is tiltably supported on the switch base.

6. The switch device as in claim 5, wherein the lock operation member is linearly movably supported on the switch lever.

7. The switch device as in claim 4, wherein the on-lock mechanism comprises a part of the lock operation member and a part of the switch base, which can contact with each other for preventing the switch lever from moving from the ON position.

8. The switch device as in claim 4, wherein the off-lock mechanism comprises a part of the lock operation member and a part of the switch base, which can contact with each other for preventing the switch lever from moving from the OFF position.

9. The switch device as in claim 4, wherein the off-lock mechanism comprises a part of the lock operation member and a slider slidably supported by the switch base, the part of the lock operation member and the slider can contact with each other for preventing the switch lever from moving from the OFF position.

10. The switch device as in claim 4, wherein the off-lock mechanism comprises a part of the switch lever and a slider slidably supported by the switch base, the part of the switch lever and the slider can contact with each other for preventing the switch lever from moving from the OFF position.

11. A switch device for a power tool, comprising:

a switch base mounted to a tool body of the power tool;

a switch lever supported on the switch base and operable to move between an ON position for activating the power tool and an OFF position for stopping activation of the power tool;

an on-lock mechanism capable of locking the switch lever in the ON position;

an off-lock mechanism capable of locking the switch lever in the OFF position;

a first operation member operable in a first direction for making the on-lock mechanism effective; and a second operation member operable in a second direction for releasing the off-lock mechanism;

wherein:

the first operation member and the second operation member are separate members from each other, and the first operation member is supported on the switch lever.

12. The switch device as in claim 11, wherein the second direction intersects with a direction for operating the switch lever between the ON position and the OFF position.

13. The switch device as in claim 11, wherein the first operation member is a separate member from the switch lever.

14. The switch device as in claim 11, wherein the switch lever is tiltably and linearly movably supported by the switch base, and the first operation member is tiltably supported on the switch lever.

15. The switch device as in claim 11, wherein the switch lever serves as the second operation member.

16. The switch device as in claim 11, wherein the on-lock mechanism comprises a part of the first operation member and a part of the switch base, which can contact with each other for preventing the switch lever from moving from the ON position.

17. The switch device as in claim 11, wherein the off-lock mechanism comprises a part of the first operation member and a part of the switch base, which can contact with each other for preventing the switch lever from moving from the OFF position.

18. A power tool comprising:

a tool body;

a motor mounted within the tool body; and a switch device mounted to the tool body and operable for starting and stopping the motor, the switch device comprising:

a switch base fixedly mounted to the tool body and including a lock base;

a switch lever supported by the switch base so as to be tiltable between an ON position for starting the motor and an OFF position for stopping the motor about a first axis; and an operation member supported by the switch lever so as to be movable together with the switch lever, the operation member being tiltable relative to the switch lever about a second axis;

wherein:

when the switch lever is in the ON position, the operation member can tilt in a first direction relative to the switch lever to engage the lock base, so that the switch lever can be locked at the ON position, and when the switch lever is in the OFF position, the operation member can tilt in the first direction relative to the switch lever to engage the lock base, so that the switch lever can be locked at the OFF position.

19. The power tool as in claim 18, wherein the operation member includes an engaging protrusion portion, the lock base includes a first portion and a second portion disposed on opposite sides with respect to the tilting direction of the operation member, the engaging protrusion portion engages the first portion of the lock base when the operation member is in a position for locking the switch lever at the ON position, and the engaging protrusion portion engages the second portion of the lock base when the operation member is in a position for locking the switch lever at the OFF position.

20. The power tool as in claim 18, further comprising a spring normally biasing the operation member in the first direction.

21. The power tool as in claim 18, wherein the first axis and the second axis are spaced from each other.

* * * * *